US011636757B2

(12) United States Patent
Kobashi et al.

(10) Patent No.: US 11,636,757 B2
(45) Date of Patent: Apr. 25, 2023

(54) SYSTEM AND METHOD FOR OPTIMIZING TRAFFIC FLOW USING VEHICLE SIGNALS

(71) Applicant: Nissan North America, Inc., Franklin, TN (US)

(72) Inventors: Atsuhide Kobashi, Sunnyvale, CA (US); Christopher Ostafew, Mountain View, CA (US); Stefan Witwicki, San Carlos, CA (US)

(73) Assignee: NISSAN NORTH AMERICA, INC., Franklin, TN (US)

( * ) Notice: Subject to any disclaimer, the term of this patent is extended or adjusted under 35 U.S.C. 154(b) by 225 days.

(21) Appl. No.: 17/008,329

(22) Filed: Aug. 31, 2020

(65) Prior Publication Data

US 2022/0068124 A1 Mar. 3, 2022

(51) Int. Cl.

| | |
|---|---|
| ***G08G 1/01*** | (2006.01) |
| ***G08G 1/083*** | (2006.01) |
| ***G08G 1/056*** | (2006.01) |

(52) U.S. Cl.

CPC ..... *G08G 1/0145* (2013.01); *G08G 1/0112* (2013.01); *G08G 1/056* (2013.01); *G08G 1/083* (2013.01)

(58) Field of Classification Search

CPC .... G08G 1/0145; G08G 1/0112; G08G 1/056; G08G 1/083

See application file for complete search history.

(56) References Cited

U.S. PATENT DOCUMENTS

| | | | | |
|---|---|---|---|---|
| 10,115,305 | B2 * | 10/2018 | Mortazavi | G08G 1/07 |
| 10,607,480 | B2 * | 3/2020 | Israelsson | G08G 1/0141 |
| 10,649,453 | B1 * | 5/2020 | Svegliato | G05D 1/0077 |
| 2015/0243165 | A1 * | 8/2015 | Elsheemy | G08G 1/096775 340/906 |
| 2016/0027300 | A1 * | 1/2016 | Raamot | G08G 1/0145 340/922 |
| 2017/0113665 | A1 * | 4/2017 | Mudalige | G08G 1/166 |
| 2018/0096597 | A1 * | 4/2018 | Mortazavi | H04W 4/027 |
| 2018/0204451 | A1 * | 7/2018 | Cross | G08G 1/005 |
| 2018/0309592 | A1 * | 10/2018 | Stolfus | G08G 1/0969 |
| 2018/0364046 | A1 * | 12/2018 | El Assaad | G05D 1/0289 |
| 2019/0251838 | A1 * | 8/2019 | Bernhardt | G08G 1/087 |
| 2019/0272748 | A1 * | 9/2019 | Cross | G08G 1/087 |
| 2019/0367021 | A1 * | 12/2019 | Zhao | B60W 60/0011 |
| 2019/0367022 | A1 * | 12/2019 | Zhao | B60W 30/18154 |
| 2019/0369616 | A1 * | 12/2019 | Ostafew | B60W 60/00274 |

(Continued)

*Primary Examiner* — Peter D Nolan
*Assistant Examiner* — Wae L Louie
(74) *Attorney, Agent, or Firm* — Global IP Counselors, LLP

(57) ABSTRACT

Systems and methods for optimizing traffic flow through an intersection are disclosed. In an embodiment, the method includes receiving positional data indicating a current location of a first vehicle intending to pass through the intersection, receiving directional data indicating an intended direction of the first vehicle through the intersection from the current location, determining, based on the positional data and the directional data, whether an intended path of the first vehicle through the intersection interferes with an alternative path through the intersection, and adjusting a traffic signal at the intersection to decrease an amount of time to pass through the intersection via the alternative path.

20 Claims, 19 Drawing Sheets

(56) References Cited

U.S. PATENT DOCUMENTS

| | | | | |
|---|---|---|---|---|
| 2020/0152054 | A1* | 5/2020 | McCall | G08G 1/0112 |
| 2020/0242922 | A1* | 7/2020 | Dulberg | G08G 1/012 |
| 2020/0334978 | A1* | 10/2020 | Pittman | H04L 47/821 |
| 2020/0365015 | A1* | 11/2020 | Nguyen | G08G 1/0129 |
| 2021/0157314 | A1* | 5/2021 | Wray | B60W 30/17 |
| 2022/0068124 | A1* | 3/2022 | Kobashi | G08G 1/0145 |
| 2022/0101723 | A1* | 3/2022 | Bill | B60W 30/18154 |

* cited by examiner

SYSTEM AND METHOD FOR OPTIMIZING TRAFFIC FLOW USING VEHICLE SIGNALS

BACKGROUND

Field of the Disclosure

The present disclosure generally relates to a system and a method for optimizing traffic flow. More specifically, the present disclosure relates to a system and a method which utilize vehicle signals to optimize traffic flow through an intersection.

Background Information

Many intersections use inductive loop detectors to detect the presence or absence of vehicles in different lanes. However, such intersections lack the ability to optimize traffic flow based on that information, since the presence of a vehicle does not necessarily indicate the vehicle's intentions. For example, in some cases, the direction that a vehicle intends to turn does not interfere with another path through the intersection. Yet without knowing that intention, the traffic light may cause all other traffic to stop, creating unnecessary stoppages for other lanes and hindering the overall flow of traffic through the intersection. This can lead to significant, and often unnecessary, traffic at the intersection.

SUMMARY

One object of the disclosure is to provide a system and a method that can use signals from vehicles to reduce the time through an intersection and the overall traffic load at the intersection.

In view of the state of the known technology, one aspect of the present disclosure is to provide a method for optimizing traffic flow through an intersection. The method comprises receiving positional data indicating a current location of a first vehicle intending to pass through the intersection, receiving directional data indicating an intended direction of the first vehicle through the intersection from the current location, determining, based on the positional data and the directional data, whether an intended path of the first vehicle through the intersection interferes with an alternative path through the intersection, and adjusting a traffic signal at the intersection to decrease an amount of time to pass through the intersection via the alternative path.

Another aspect of the present disclosure is to provide an alternative method for optimizing traffic flow through an intersection. The method comprises receiving positional data indicating a current location of a first vehicle intending to pass through the intersection, receiving directional data indicating an intended direction of the first vehicle through the intersection from the current location, determining, based on the positional data and the directional data, an intended path of the first vehicle through the intersection, determining whether a total number of other vehicles stopped at the intersection can be reduced without interfering with the intended path, and adjusting a traffic signal at the intersection to decrease an amount of time needed to reduce the total number of other vehicles stopped at the intersection.

Another aspect of the present invention is to provide another alternative method for optimizing traffic flow through an intersection. The method comprises receiving, from a first vehicle stopped at the intersection, first positional data indicating a first current location and first directional data indicating a first intended direction through the intersection, receiving, from a second vehicle stopped at the intersection, second positional data indicating a second current location and second directional data indicating a second intended direction through the intersection, determining, based on the first positional data and the first directional data, a first intended path of the first vehicle through the intersection, determining, based on the second positional data and the second directional data, a second intended path of the second vehicle through the intersection, determining whether the first current position of the first vehicle prevents the second vehicle from proceeding through the intersection along the second intended path, and adjusting a traffic signal at the intersection to allow the first vehicle to pass through the intersection along the first intended path.

Other objects, features, aspects and advantages of the systems and methods disclosed herein will become apparent to those skilled in the art from the following detailed description, which, taken in conjunction with the annexed drawings, discloses exemplary embodiments of the disclosed system and method for optimizing traffic.

BRIEF DESCRIPTION OF THE DRAWINGS

Referring now to the attached drawings which form a part of this original disclosure.

DETAILED DESCRIPTION OF EXEMPLARY EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
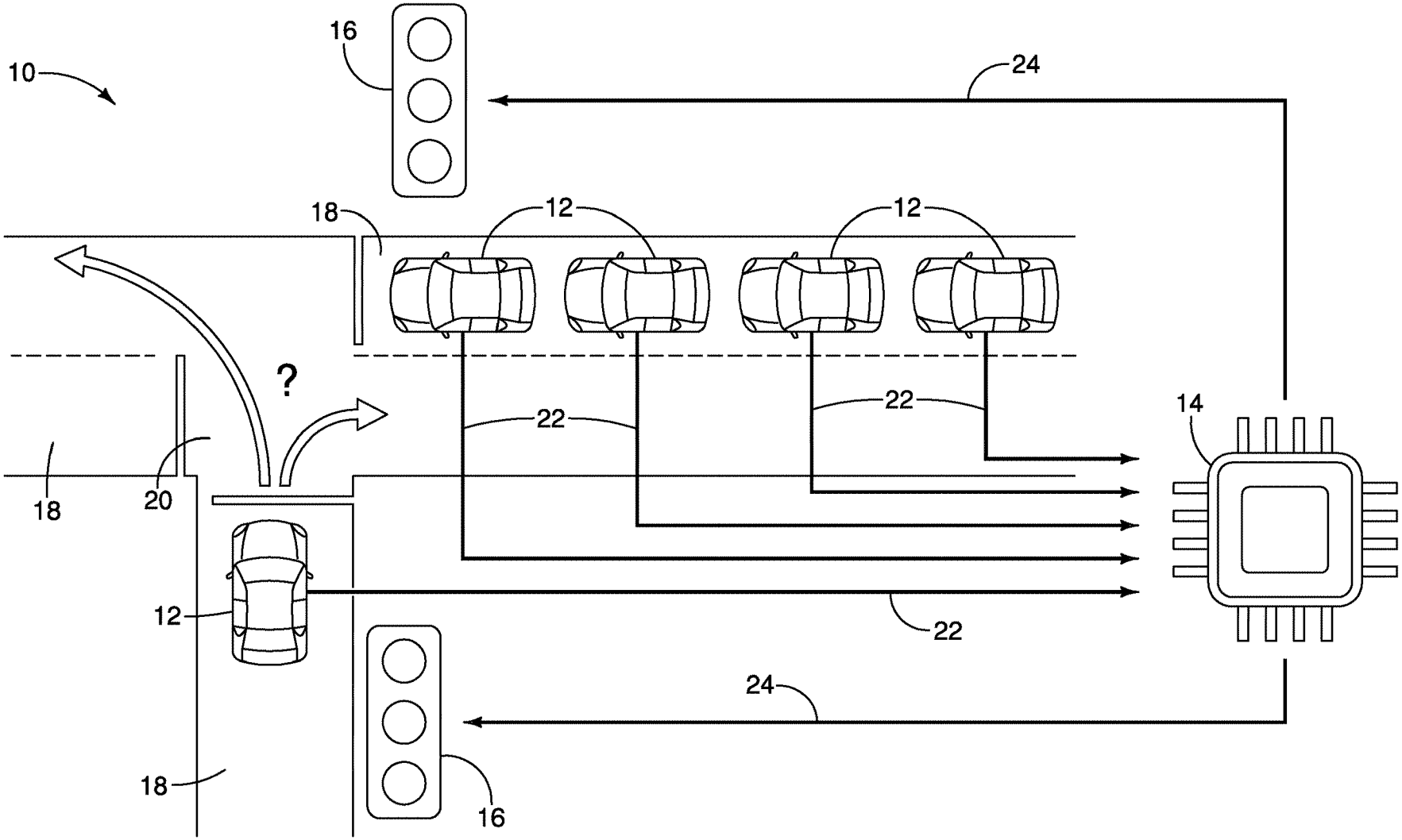
FIG. 1 is a schematic diagram of an example embodiment of a system for optimizing traffic flow through an intersection in accordance with the present disclosure.

FIG. 1 illustrates an example embodiment of a system 10 for optimizing traffic flow through an intersection 20. In the illustrated embodiment, the system 10 includes a plurality of vehicles 12, a central controller 14, and at least one traffic light 16. Here, the plurality of vehicles 12 are located within various lanes 18 leading into the intersection 20. As explained in more detail below, the central controller 14 is configured to accept a first signal 22 from one or more vehicle 12, process the first signal 22 to optimize the flow of traffic through the intersection 20, and send a second signal 24 to at least one traffic light 16 to adjust the traffic signal and thereby decrease an amount of time for one or more vehicle 12 to proceed through the intersection 20.

Figure 2:
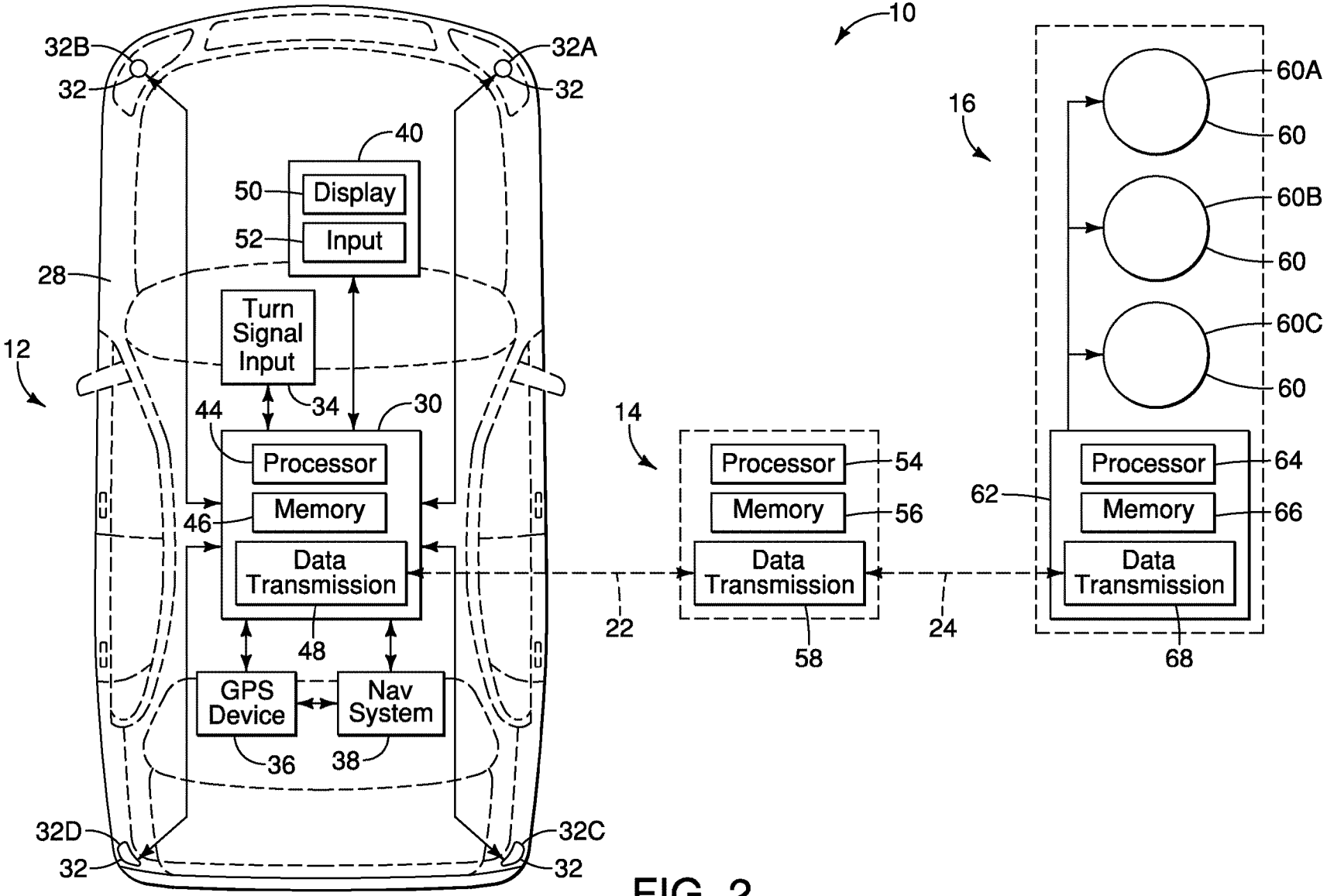
FIG. 2 is another schematic diagram of the system of FIG. 1.

FIG. 2 illustrates the system 10 in more detail. Specifically, FIG. 2 illustrates example embodiments of a vehicle 12, a central controller 14, and a traffic light 16. It should be understood from this disclosure that these are example embodiments only and the specific components and operation of a vehicle 12, a central controller 14, and a traffic light 16 can vary.

As illustrated in FIG. 2, a vehicle 12 used by the system 10 can include a vehicle body 28 and a vehicle controller 30. The vehicle body 28 can include one or more of a plurality of turn signals 32, a turn signal input device 34, a global positioning satellite ("GPS") device 36, a vehicle navigation system 38, and a user interface 40, which can each be placed in wired or wireless communication with the vehicle controller 30 to enable the vehicle controller 30 to gather data 42 for transmission to the central controller 14 in accordance with the method discussed herein.

The vehicle controller 30 can include one or more of a vehicle processor 44, a vehicle memory 46, and a data transmission device 48. The vehicle processor 44 is configured to execute instructions programmed into and/or stored by the vehicle memory 46. As described in more detail below, many of the steps of the methods described herein can be stored as instructions in the vehicle memory 46 and executed by the vehicle processor 44. The vehicle memory 46 can include, for example, a non-transitory storage medium. The data transmission device 48 can include, for example, a transmitter and a receiver configured to send and receive wireless signals to and from the central controller 14 in accordance with methods known in the art. For example, the data transmission device 48 can be configured for short-range wireless communication, such as Bluetooth communication, and/or for communication over a wireless network.

The plurality of turn signals 32 can include a front right turn signal 32A, a front left turn signal 32B, a back right turn signal 32C, and a back left turn signal 32D, each of which can be controlled by the driver using the turn signal input device 34. Typically, the front right turn signal 32A and the back right turn signal 32C operate in unison when the turn signal input device 34 is in a right turn position, the front left turn signal 32B and the back left turn signal 32D operate in unison when the turn signal input device 34 is in a left turn position, and none of the turn signals 32 operate when the turn signal input device 34 is in a neutral position. The turn signal input device 34 can be, for example a lever, a switch, a button, or another physical device controlled by the driver of the vehicle 12. Alternatively, the plurality of turn signals 32 can be automatically controlled by the vehicle controller 30 without input from the driver using the turn signal input device 34. For example, the vehicle controller 30 can automatically control the plurality of turn signals 32 based on route information stored by the vehicle navigation system 38. In the context of the turn signals 32, "right" and "left" refer to the right side of the vehicle 12 and the left side of the vehicle 12 from the driver's perspective when looking forward.

The GPS device 36 is configured to determine location data regarding the physical location of the vehicle 12 and communicate the location data to the vehicle controller 30 for transmission to the central controller 14. The GPS device 36 can determine the location data, for example, via communication with one or more global positioning satellite as known in the art. The GPS device 36 can also determine the location data, for example, via communication with one or more terrestrial units and a base station or external server. In an embodiment, the GPS device 36 can be part of or placed in communication with the vehicle navigation system 38.

The vehicle navigation system 38 can include the GPS device 36 or be placed in communication with the GPS device 36. The vehicle navigation system 38 can also include or be placed in communication with a storage device that can store vehicle information, such as the location data determined by the GPS device, previous vehicle route information, previous location information, or other vehicle information that the GPS device 38 is capable of generating, in addition to map data and other location related data as understood in the art. In an embodiment, the vehicle navigation system 38 can receive a destination address from a driver and generate an optimal route to that destination address, wherein the optimal route passes through one or more intersection 20 configured as discussed herein. The vehicle navigation system 38 can further cause the optimal route to be displayed to the driver via the user interface 40.

The user interface 40 can include one or more of a display 50 and an input device 52. In an embodiment, the display 50 and the input device 52 can be part of a graphical user interface such as a touch screen which enables a driver to input and view information regarding various aspects of the vehicle 12. In an embodiment, the user interface 40 can enable the driver of the vehicle 12 to access the vehicle navigation system 38, which allows the driver to input a destination address using the input device 52 and generate route information that is displayed on the display 50.

The central controller 14 can be a traffic light controller associated specifically with the traffic lights 16 at an intersection 20, or can be a general controller which communicates with one or more separate traffic light controller controlling the signals of one or more traffic light 16. As described in more detail below, the central controller 14 is configured to constantly update traffic control instructions for the traffic lights 16 based on data 42 received from one or more vehicle controller 30.

The central controller 14 can include one or more of a central processor 54, a central memory 56, and a data transmission device 58. The central processor 54 is configured to execute instructions programmed into and/or stored by the central memory 56, and many of the steps of the methods described herein can be stored as instructions in the central memory 56 and executed by the central processor 54. The central memory 56 can include, for example, a non-transitory storage medium. The data transmission device 58 can include, for example, a transmitter and a receiver configured to send and receive wireless signals to and from the vehicle controller 30 and/or the traffic lights 16 in accordance with methods known in the art. For example, the data transmission device 58 can be configured for short-range wireless communication, such as Bluetooth communication, and/or for communication over a wireless network.

The traffic light 16 can be, for example, a standard traffic light with at least one traffic signal 60. In FIG. 2, the traffic light includes a first traffic signal 60A (e.g., a red light), a second traffic signal 60B (e.g., a yellow light), and a third traffic signal 60C (e.g., a green light). It should be understood from this disclosure, however, that the traffic light 16 can be embodied in other forms. For example, the traffic light 16 can include other signals 60, for example, left or right turn only signals. In another embodiment, the traffic light 16 can include a single signal 60 which indicates, for example, "Stop" or "Go." In yet another embodiment, the traffic light 16 can be for a pedestrian walkway, for example, and can signal whether a pedestrian is permitted to cross a lane 18 of an intersection 20 using the pedestrian walkway. Those of ordinary skill in the art will recognize from this disclosure that there are various types of traffic lights which can advantageously be used with the system and method discussed herein.

In an embodiment, the traffic light 16 can include its own signal controller 62 which is separate from the central controller 14. Alternatively, if the central controller 14 is a traffic light controller directly associated with the traffic light 16, then the traffic light may not require its own signal controller 62. If present, the signal controller 62 can include one or more of a signal processor 64, a signal memory 66, and a data transmission device 68. The signal processor 64 is configured to execute instructions programmed into and/or stored by the signal memory 66, and many of the steps of the methods described herein can be stored as instructions in the signal memory 66 and executed by the signal processor 64. The signal memory 66 can include, for example, a non-transitory storage medium. The data transmission device 68 can include, for example, a transmitter and a receiver configured to send and receive wireless signals to and from the central controller 14 in accordance with methods known in the art. For example, the data transmission device 68 can be configured for short-range wireless communication, such as Bluetooth communication, and/or for communication over a wireless network.

As illustrated, the signal controller 62 can be wired or wirelessly connected to at least one traffic signal 60 (e.g., signals 60A, 60B and 60C in FIG. 2). Based on traffic control instructions 70 received from the central controller 14, the signal controller 62 can cause one or more of the traffic signals 60 to be adjusted. Alternatively, the central controller 14 can bypass the signal controller 62 and cause the adjustment to one or more traffic signal 60 directly.

Figure 3:
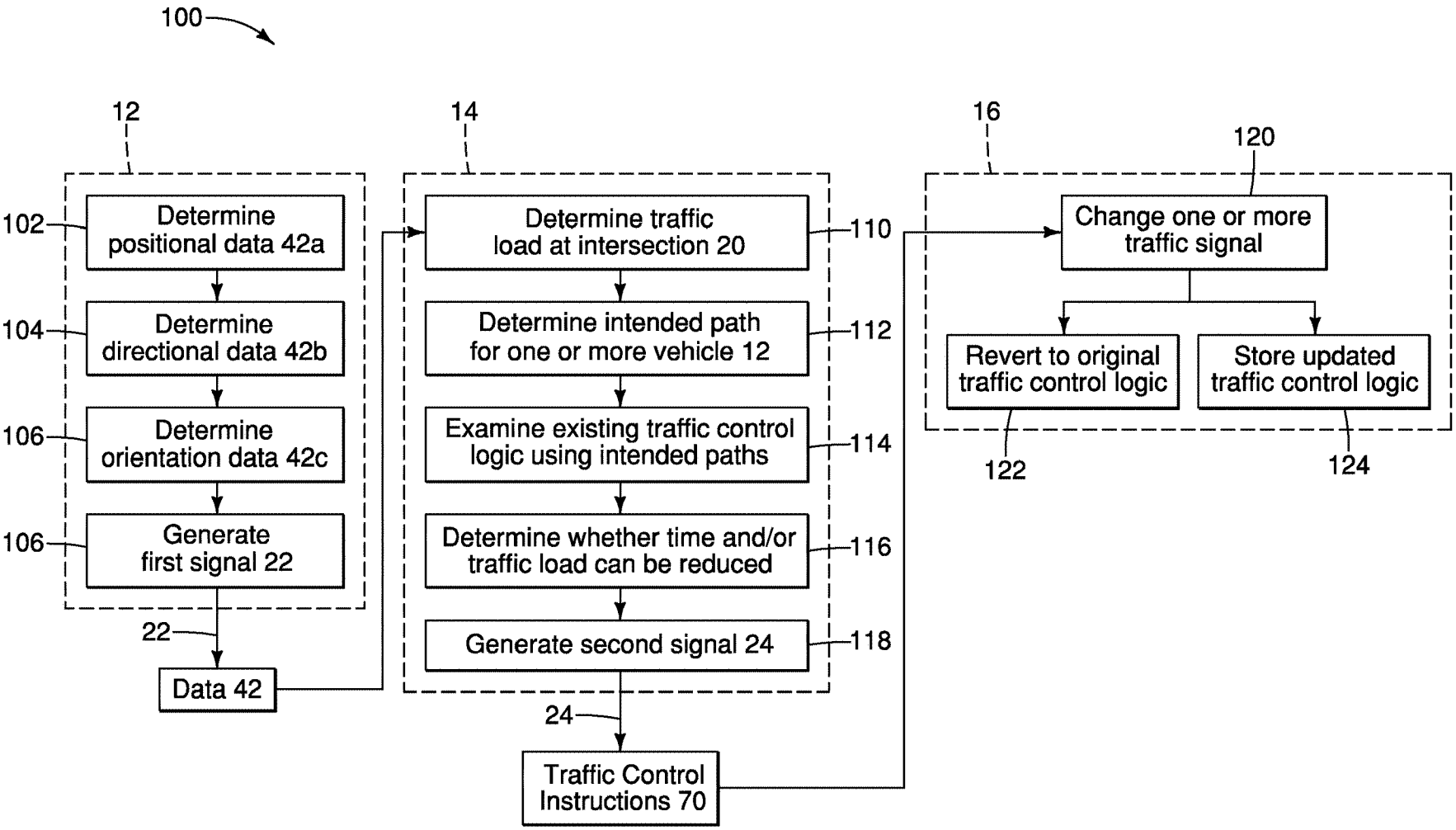
FIG. 3 is a flow chart of an example embodiment of a method for optimizing traffic flow through an intersection in accordance with the present disclosure.

FIG. 3 illustrates a method 100 for optimizing traffic flow through an intersection 20 using the system 10 of FIGS. 1 and 2. Some or all of the steps of method 100 can be stored as instructions on the vehicle memory 46, the central memory 56, and/or the signal memory 66 and can be executed by the vehicle processor 44, the central processor 54, and/or the signal processor 64 in accordance with the respective instructions stored on the vehicle memory 46, the central memory 56, and/or the signal memory 66. It should be understood from this disclosure that some of the steps described herein can be reordered or omitted without departing from the spirit or scope of method 100.

At step 102, a vehicle 12 is approaching and/or stopped at an intersection 20. As the vehicle 12 approaches and/or stops at the intersection, the GPS device 36 continuously or periodically generates a GPS signal regarding the current location of the vehicle 12. The current location of the vehicle 12 can be transmitted from the GPS device 36 to the vehicle controller 30 and can be stored as positional data 42*a* in the vehicle memory 46. In an embodiment, the positional data 42*a* can include an indication of the current location of a vehicle 12 intending to pass through the intersection 20. The positional data 42*a* can include, for example, geographic coordinates for the precise physical location of the vehicle 12. The geographic coordinates can include, for example, latitude and longitude coordinates or other local coordinates which can be specific to the intersection 20.

At step 104, which can occur before, after, or at the same time as step 102, the driver and/or the vehicle controller 30 initiates a turn signal 32 indicating which direction the vehicle 12 intends to turn through the intersection 20. The driver can initiate the turn signal 32 using the turn signal input device 34. Alternatively, the vehicle controller 30 can automatically initiate the turn signal 32 based on route information from the vehicle navigation system 38. The driver and/or the vehicle controller 30 can also initiate no turn signal and/or leave the turn signal input device 34 in neutral position to indicate an intention to proceed straight through the intersection 20. At various different intersections 20, the driver and/or the vehicle controller 30 can further distinguish between other directions, for example, sharp right or left turns and/or soft right or left turns. The intended direction of the vehicle can be stored as directional data 42*b* in the vehicle memory 46. In an embodiment, the directional data 42*b* can include, for example, an indication of left, right, or straight, corresponding to the intended direction of the vehicle 12.

Optionally, at step 106, which can occur before, after, or at the same time as steps 102 and/or 104, the vehicle controller 30 and/or the GPS device 36, using the GPS data over a period of time, can determine the orientation of the vehicle 12 based on the direction that the vehicle 12 traveled toward the intersection 20. For example, if the vehicle's GPS device 36 indicates that the vehicle 12 has been traveling in a northward direction immediately prior to approaching the intersection 20, then the vehicle controller 30 and/or the GPS device 36 can determine the vehicle 12 to be oriented northwardly. The orientation of the vehicle can be stored as orientation data 42*c* in the vehicle memory 46. In an embodiment, the orientation data 42*c* can include, for example, an orientational coordinate between 0 and 360 degrees which provides an angle of orientation related to north, south, east, west, and/or combinations thereof.

At step 108, the vehicle controller 30 generates at least one first signal 22 including data 42 regarding the vehicle's intended path through the intersection 20. The data 42 can include one or more of the positional data 42*a*, the directional data 42*b* and/or the orientation data 42*c*. The data 42 can also include other types of data associated with the vehicle's position, route, or other intentions. The positional data 42*a* can include, for example, a current location of the vehicle 12 as determined by the GPS device 36 and/or the vehicle controller 30. The directional data 42*b* can include, for example, an intended direction of the vehicle 12 through the intersection from the current location as determined by the turn signal input device 34 and/or the vehicle controller 30. The orientation data 42*c* can include, for example, the directional orientation of the vehicle 12 as determined by the GPS device 36 and/or the vehicle controller 30. The first signal 22 can then be transmitted to the central controller 14 so that the data 42 can be further processed by the central controller 14 and used to optimize traffic through the intersection 20.

In an embodiment, at least one first signal 22 can be generated and/or transmitted to the central controller 14 when the driver and/or the vehicle controller 30 initiates the turn signal 32 indicating which direction the vehicle 12 intends to turn through the intersection 20. In this case, once the turn signal 32 is initiated, the vehicle controller 30 can affirmatively determine that the vehicle 12 does not intend to proceed straight through the intersection 20, and instead intends to turn right or left. Thus, at the time that the turn is signaled, at least one first signal 22 can be generated with data 42 including one or more of the positional data 42*a*, the directional data 42*b* and/or the orientation data 42*c*.

In another embodiment, at least one first signal 22 can be generated once the vehicle 12 comes to a stop at the intersection 20. In this case, when the vehicle 12 comes to a stop, the vehicle controller 30 can determine that the vehicle 12 intends to proceed straight through the intersection 20 if a turn signal 32 has not been activated by this time, or that the vehicle 12 intends to proceed right or left if a turn signal 32 has been activated by this time. Thus, at the time when the vehicle 12 stops at the intersection 20, at least one first signal 22 can be generated with data 42 including one or more of the positional data 42*a*, the directional data 42*b* and/or the orientation data 42*c*. By waiting for the vehicle 12 to come to a stop, the controller 30 accounts for the situation that the turn signal 32 may not be initiated if the driver intends to proceed straight through the intersection 20, assuming that the driver would have signaled to turn by then if a turn is intended. If the route information is already known from the vehicle navigation system 38, the controller 30 can generate the first signal 22 when the vehicle stops using that known information regarding the vehicle's intended route.

In yet another embodiment, at least one first signal 22 can be generated once the vehicle 12 comes within a predetermined distance of the intersection 20. In this case, once the vehicle 12 comes within the predetermined distance of the intersection 20, the vehicle controller 30 can determine that the vehicle 12 intends to proceed straight through the intersection 20 if a turn signal 32 has not been activated by this time, or that the vehicle 12 intends to proceed right or left if a turn signal 32 has been activated by this time. Thus, when the vehicle 12 comes within the predetermined distance of the intersection 20, at least one first signal 22 can be generated with data 42 including one or more of the positional data 42*a*, the directional data 42*b* and/or the orientation data 42*c*. The predetermined distance can be determined, for example, using the GPS device 36. By waiting for the vehicle 12 to come within the predetermined distance of the intersection 20, the controller 30 accounts for the situation that the turn signal 32 may not be initiated if the driver intends to proceed straight through the intersection 20, assuming that the driver would have signaled to turn by then if a turn is intended. If the route information is already known from the vehicle navigation system 38, the controller 30 can generate the first signal 22 at the predetermined distance using that known information regarding the vehicle's intended route.

There are also circumstances in which the driver of the vehicle 12 can change the turn signal 32 after indicating an intended direction initially, or the driver can be late to activate a turn signal 32. This can happen, for example, if the driver mistakenly indicated the wrong direction initially or changes his or her mind after an initial signaling. In these circumstances, if an initial first signal 22 has already been generated and transmitted to the central controller 14, an updated first signal 22 with updated or corrected data 42 can be transmitted to the central controller 14 each time the turn signal 32 is changed or turned on or off. Alternatively, the first signal 22 can continuously or periodically be generated and transmitted to the central controller 14, such that the central controller 14 is continuously or periodically receiving current data 42 regarding the vehicle 12. The first signal 22 can be continuously or periodically updated by the vehicle controller 30, for example, beginning when the vehicle 12 approaches within a predetermined distance of the intersection 20, and lasting until the vehicle 12 pulls through the intersection 20.

It should be understood from this disclosure that steps 102, 104, 106 and 108 can be performed by a plurality of vehicles 12 approaching and/or stopping at the intersection 20. Thus, the central controller 14 is constantly receiving a plurality of first signals 22 containing a plurality of data 42 including the positional data 42*a*, the directional data 42*b* and/or the orientation data 42*c* of multiple vehicles 12. Using the data 42 from the plurality of vehicles 12, the central controller 14 can optimize signals 60 from the traffic lights 16 to benefit the overall flow of traffic, as described in more detail below.

At step 110, the central controller 14 receives one or more first signals 22 from one or more vehicles 12. In most cases, the central controller 14 receives a plurality of first signals 22 from a plurality of respective vehicles 12. In an embodiment, the central controller 14 receives first signals 22 with data 42 including positional data 42*a* and directional data 42*b*. The central controller 14 can also receive orientation data 42*c*, or the central controller 14 can determine the orientation data 42*c* for one or more vehicle 12, knowing the lane 18 that each vehicle 12 is located in based on the positional data 42*a*. In an embodiment, the central controller 14 only requires the positional data 42*a* and the directional data 42*b* to implement the methods discussed herein.

At step 110, the central controller 14 can determine the traffic load at the intersection 20. The traffic load can include the total number of vehicles 12 at the intersection 20, the total number of vehicles 12 in one or more lane 18, and/or the total number of vehicles 12 transmitting first signals 22 to the central controller 14. The determined traffic load can be an exact number or an estimate based on the data 42 received via the first signals 22.

In an embodiment, the central controller 14 only receives first signals 22 from some of the vehicles 12 at an intersection 20. This can happen, for example, if one or more vehicle 12 at the intersection 20 is not configured to transmit first signals 22, has disabled the ability to transmit first signals 22, or has a malfunctioning component. In these cases, the central controller 14 can still estimate a total number of vehicles 12 located within a lane 18 and/or at the intersection 20 based on the first signals 22 from other vehicles and/or sensors or other devices located at the intersection 20. Alternatively, the central controller 14 can estimate the total load as the number of vehicles 12 transmitting first signals 22.

In one embodiment, the central controller 14 can use the first signals 22 received from one or more vehicle 12 at the intersection 20 to determine that other vehicles 12 are present but not emitting first signals 22. For example, using the positional data 42*a* from two known vehicles 12 in the same lane 18, the central controller 14 can determine there to be a third vehicle 12 located between the two known vehicles 12 if there is enough space between the two known vehicles 12 for a third vehicle 12. If there is not enough space for a third vehicle 12 between the two known vehicles 12, then the central controller 14 can determine there to be only the two known vehicles 12 emitting first signals 22 located within the lane 18. Thus, in this case, the central controller 14 can determine positional data 42*a* for a vehicle 12 not transmitting a first signal 22, and thus use that third vehicle 12 in a traffic load estimation.

In another embodiment, the central controller 14 can combine data 42 from the first signals 22 with other sensor data at the intersection 20 to determine the traffic load. For example, many intersections 20 include inductive loop detectors, which detect the presence of vehicles 12 using an electrical current. In this case, for example, if the central controller 14 receives first signals 22 from two vehicles 12 in a lane 18, but also determines from a sensor (e.g., an inductive loop detector) that three vehicles 12 are located within that lane 18, the central controller 14 can determine that a third vehicle 12 is present but not transmitting a first signal 22 including data 42. In another embodiment, a sensor can include a smart camera with the ability to count the total number of vehicles 12 in one or more lane 18 of the intersection 20. Thus, in some cases, the central controller 14 can determine positional data 42*a* for a vehicle 12 not transmitting a first signal 22.

At step 112, the central controller 14 can determine the direction that one or more vehicle 12 intends to turn using the directional data 42*b* from the first signals 22. In an embodiment, the central controller 14 can also use the lane type to determine an intended direction in cases where a lane 18 only allows one direction (e.g., left turn only lane, right turn only lane, straight only lane.) Thus, in some cases, the central controller 14 can determine the directional data 42*b* for a vehicle 12 using the positional data 42*a* for that vehicle 12. In another embodiment, the central controller 14 can use a smart camera to detect whether one or more vehicle 12 is or is not flashing a turn signal, and can thus determine directional data 42*b* for the vehicle 12 using that information. Thus, in some cases, the central controller 14 can determine directional data 42 for a vehicle 12 that is not transmitting a first signal 22.

Using the positional data 42*a* and/or the directional data 42*b*, the central controller 14 can determine an intended path for one or more vehicle 12. As used herein, the intended path refers to the path of the vehicle 12 through the intersection 20, beginning with the current location of the vehicle 12 and/or ending when the vehicle 12 exits the intersection 20. When dealing with a plurality of vehicles 12 at an intersection 20, the central controller 14 can determine intended paths for most or all of the vehicles 12, depending on the number of vehicles 12 emitting first signals 22, the types of lanes 18 at the intersection 20, and the other information available to the central controller 14 as discussed herein.

At step 114, the central controller 14 can use the current load at the intersection, along with the known intended paths of one or more vehicle 12 at the intersection 20, to estimate an amount of time for one or more vehicle 12 to pass through the intersection 20 under the existing traffic control logic being applied to the traffic signals 60 at the intersection 20. The existing traffic control logic can include, for example, the logic which controls the traffic control signals 60 absent an intervention from the central controller 14. The amount of time can include, for example, an amount of time for each vehicle 12 to pass through the intersection 20, an amount of time for each lane 18 to clear out, and/or an amount of time in relation to decreasing a total load within a lane 18 and/or at the intersection 20.

Figure 4:
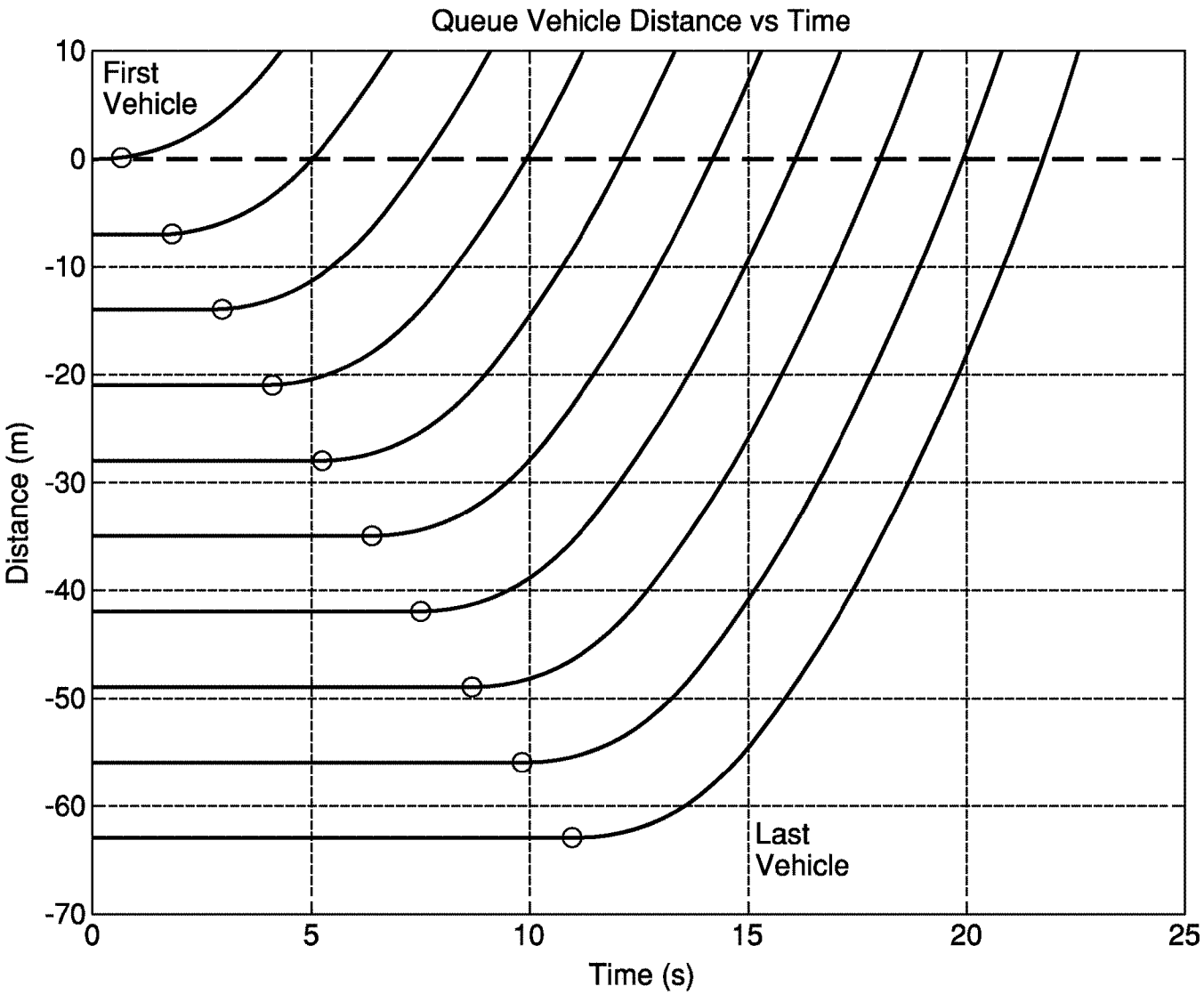
FIG. 4 is a chart illustrating an example embodiment of how the time for a plurality of vehicles to pass through an intersection can be calculated in accordance with the present disclosure.

In a simplified example embodiment, the existing traffic control logic causes the traffic signals 60 of two traffic lights 16 to alternate allowing traffic to pass in perpendicular directions every 30 seconds. In this example, with four vehicles waiting to pass through each of the two perpendicular lanes 18, the central controller 14 can determine that four vehicles from one of the lanes 18 will clear through the intersection in 0-30 seconds, and that the remaining four vehicles 12 from the other lane 18 will clear through the intersection in 30-60 seconds. The central controller 14 can also determine a more exact time for the vehicles 12 to clear through the intersection, for example, knowing or estimating the total load within each lane 18. For example, FIG. 4 illustrates an example chart of the amount of time for a number of vehicles 12 to turn through an intersection 20 based on the distance and/or total load. Using this or a similar algorithm, the central controller 14 can determine an amount of time for one or all of the vehicles to pass through the intersection 20 once the total traffic load is known or estimated.

It should be understood from this disclosure that most implementations of the method 100 discussed herein will be more complicated than the above example of two lanes programmed to alternate traffic signals for the same amount of time. Most intersections have vehicles 12 passing in more than two directions, use different amounts of time for different directions, include multiple lanes 18 in the same direction, include turn only lanes 18, and/or include lanes 18 which overlap. It is these cases which can be most benefitted using the method 100 discussed herein, as explained in more detail with respect to the examples discussed below. The example provided above is merely for the purpose of understanding one embodiment of how the central controller 14 can examine existing traffic control logic at an intersection 20.

At step 116, the central controller 14 can determine whether altering the traffic signals can result in a reduction of time stopped at the intersection 20 for one or more vehicle 12 and/or a reduction of the total load at the intersection 20. In an embodiment, the central controller 14 can calculate or estimate, for alternative traffic control options, an amount of time for each vehicle to pass through the intersection 20, an amount of time for each lane 18 to clear out, and/or an amount of time in relation to decreasing a total load within a lane 18 and/or at the intersection 20.

In an embodiment, the central controller 14 can determine whether altering the traffic signals 60 can result in a reduction of time and/or a traffic load by determining whether the intended path of one vehicle 12 interferes with an alternative path of another vehicle 12. More specifically, the central controller 14 can determine whether the first intended path of a first vehicle 12A at the intersection interferes with an alternative second intended path of a second vehicle 12B at the intersection. If the intended paths do not interfere with each other, then both the first vehicle 12A and the second vehicle 12B can be allowed to proceed simultaneously, thus decreasing the time at the intersection 20 for whichever vehicle 12 would have been forced to wait for the other vehicle 12 under the existing traffic control logic. The first intended path can interfere with the second intended path in a variety of ways. In one embodiment, the first vehicle 12A can be facing a different direction than the second vehicle 12B, and the first intended path can interfere with the second intended path by crossing the second intended path. In another embodiment, the first vehicle 12A can be facing the same direction as the second vehicle 12B, and the first intended path can interfere with the second intended path by crossing the second intended path. In another embodiment, the first vehicle 12A can be facing the same direction as the second vehicle 12B, and the first intended path can interfere with the second intended path because the current location of the first vehicle 12A lies in the way of the second intended path. In yet another embodiment, an alternative path can be for a pedestrian passing through the intersection 20 along a walkway, and the intended path can pass through the walkway.

Thus, by determining the intended paths for a plurality of vehicles 12, the traffic load at an intersection 20 can be quickly reduced by allowing vehicles 12 to proceed as long as their respective intended paths do not interfere with each other. That is, the central controller 14 can determine or estimate a total number of vehicles stopped at the intersection. The central controller 14 can also determine whether the total number of vehicles 12 stopped at the intersection 20 can be reduced by an alternative traffic control option without interfering with another vehicle 12's intended path. The central controller 14 can then adjust at least one traffic signal 60 at the intersection 20 to allow the vehicles 12 with non-interfering paths to pass through the intersection 20, thus decreasing the amount of time needed to reduce the total number of vehicles 12 stopped at the intersection. For example, in an embodiment, upon determining that the total number of other vehicles 12 stopped at the intersection can be reduced without interfering with the intended path of a first vehicle 12A, the central controller 14 can adjust a traffic signal to allow at least one of the other vehicles to immediately proceed through the intersection 20. In another embodiment, upon determining that the total number of other vehicles 12 stopped at the intersection cannot be reduced without interfering with the intended path of a first vehicle 12A, the central controller 14 can adjust a traffic signal 60 to allow the first vehicle 12A to immediately proceed through the intersection.

In an embodiment, the central controller 14 can have a plurality of alternative traffic control options stored in the central memory 46, and can determine whether altering the traffic signals 60 can result in a reduction of time for each of the stored alternative traffic control options. The alternative traffic control options can include alternative options which add or subtract various amounts of time to the display of traffic signals 60 using the existing traffic control logic. The alternative traffic control options can include alternative options which alternate traffic signals 60 that are set to be displayed using the existing traffic control logic. The amount of time used in calculations can be based, for example, on the traffic load determined at step 110.

In another embodiment, the central controller 14 can have an optimization algorithm stored in the central memory 56, and can use the optimization algorithm to calculate optimal timing for one or more traffic signal 60. For example, the optimization algorithm can include the total load in one or more lane 18 as an input, such that the central controller 14 can calculate an amount of time needed to clear some or all of the total load from a lane 18. For example, using the algorithm embodied by the chart of FIG. 4, the central controller 14 can determine the total amount of time that it takes to clear out a lane 18 based on the number of vehicles in that lane, and can use that timing to calculate optimal timing for the alternative traffic control option. In an embodiment, the central controller 14 can calculate a time for a number of vehicles 12 within a predetermined distance of an intersection 20 to pass through the intersection 20, and can use that time to adjust a traffic signal 60.

At step 118, the central controller 14 can generate a second signal 24 including a traffic control instruction 70 with updated traffic control logic. The second signal 24 can then be transmitted to one or more traffic light 16 at the intersection 20. The traffic control instruction 70 can include an instruction to alter one or more traffic signal 60 of one or more traffic light 16, for example, by increasing or decreasing a time of one or more traffic signal 60 for at least one direction through the intersection 20, by immediately changing one or more traffic signal 60 (e.g., from red to green, or vice versa), by changing one or more traffic signal 60 after a delay, by altering an order of traffic signals 60 for alternative lanes 18 through the intersection 20, and/or the like. The second signal 24 can be wirelessly transmitted to one or more signal controller 62 for each traffic light 16 if the traffic light 16 includes a signal controller 62, or the second signal 24 can be used to directly cause the traffic signal 60 to change if the central controller 14 is a traffic light controller already wired or wirelessly connected to the traffic signals 60.

If, at step 116, the central controller 14 determines that the existing traffic control logic is already suitable, then the central controller 14 does not generate the second signal 24 at step 118 and cause the traffic signals 60 to be altered according to the updated traffic control logic. The existing traffic control logic can be deemed suitable by the central controller 14, for example, if the central controller 14 determines that an amount of time for one or more vehicle 12 to pass through the intersection 20 will not be improved using an alternative traffic control option. The amount of time can include, for example, an amount of time for each vehicle 12 to pass through the intersection 20, an amount of time for each lane 18 to clear out, and/or an amount of time in relation to decreasing a total load within a lane 18 and/or at the intersection 20. In an embodiment, the central controller 14 can deem the existing traffic control logic to be suitable if the amount of time and/or decrease in traffic load from alternative options does not meet a predetermined threshold. Thus, an alternative traffic control option can result in a minor decrease in time or a minor load reduction as determined at step 116 and still be deemed to be not enough of an improvement to justify altering the traffic signals at step 118. The specific threshold for determining whether to use updated traffic control logic can depend on the type of intersection 20 and/or typical amount of traffic (e.g., larger intersections can have larger thresholds for change).

At step 120, one or more traffic light 16 receives the second signal 24. The second signal 24 can be received by a signal controller 62 for each traffic light 16 or by a signal controller 62 for a group of traffic lights 16. Alternatively, if the central controller 14 is a traffic light controller, the second signal 24 can be a direct instruction which adjusts a traffic signal 60 (e.g., directly cause a change from red to green, or vice versa). Regardless, the second signal 24 can cause at least one traffic signal adjustment. The adjustment can include, for example, an increase or decrease of an amount of time for one or more traffic signal 60 to remain in a certain state (e.g., red or green), an immediate change from one state to another (e.g., from red to green, or vice versa), a delayed change from one state to another (e.g., from red to green, or vice versa), a change in an order of traffic signals for alternative lanes 18 through the intersection 20, and/or the like.

In an embodiment, at step 122, the adjustment according to the updated traffic control logic can be only temporary, and the traffic lights 16 at the intersection 20 can revert to the original traffic control logic after one iteration of the updated traffic control logic.

Alternatively, at step 124, the updated traffic control logic can continue to be implemented by one or more traffic light 16 until the central controller 14 sends another second signal 24 which instructs another adjustment. In an embodiment, the central controller 14 can learn from traffic patterns over a period of time and create optimal traffic control logic based thereon. For example, if the central controller 14 is constantly changing the traffic control logic to a specific pattern, then after a predetermined number of times causing the adjustment, the central controller 14 can cause the specific pattern to be permanent. In this way, the central controller 14 can develop an optimal traffic control logic and minimize the number of additional adjustments that need to be made during abnormal traffic periods.

In FIG. 3, steps 102 to 108 are shown as occurring at the vehicle 12, steps 110 to 118 are shown as occurring at the central controller 14, and steps 120 to 124 are shown as occurring at the traffic light 16. It should be understood from this disclosure, however, that many of the steps can be performed at different locations and/or by difference components, and can be rearranged accordingly and still fall within the scope of the present disclosure.

Figure 5A:
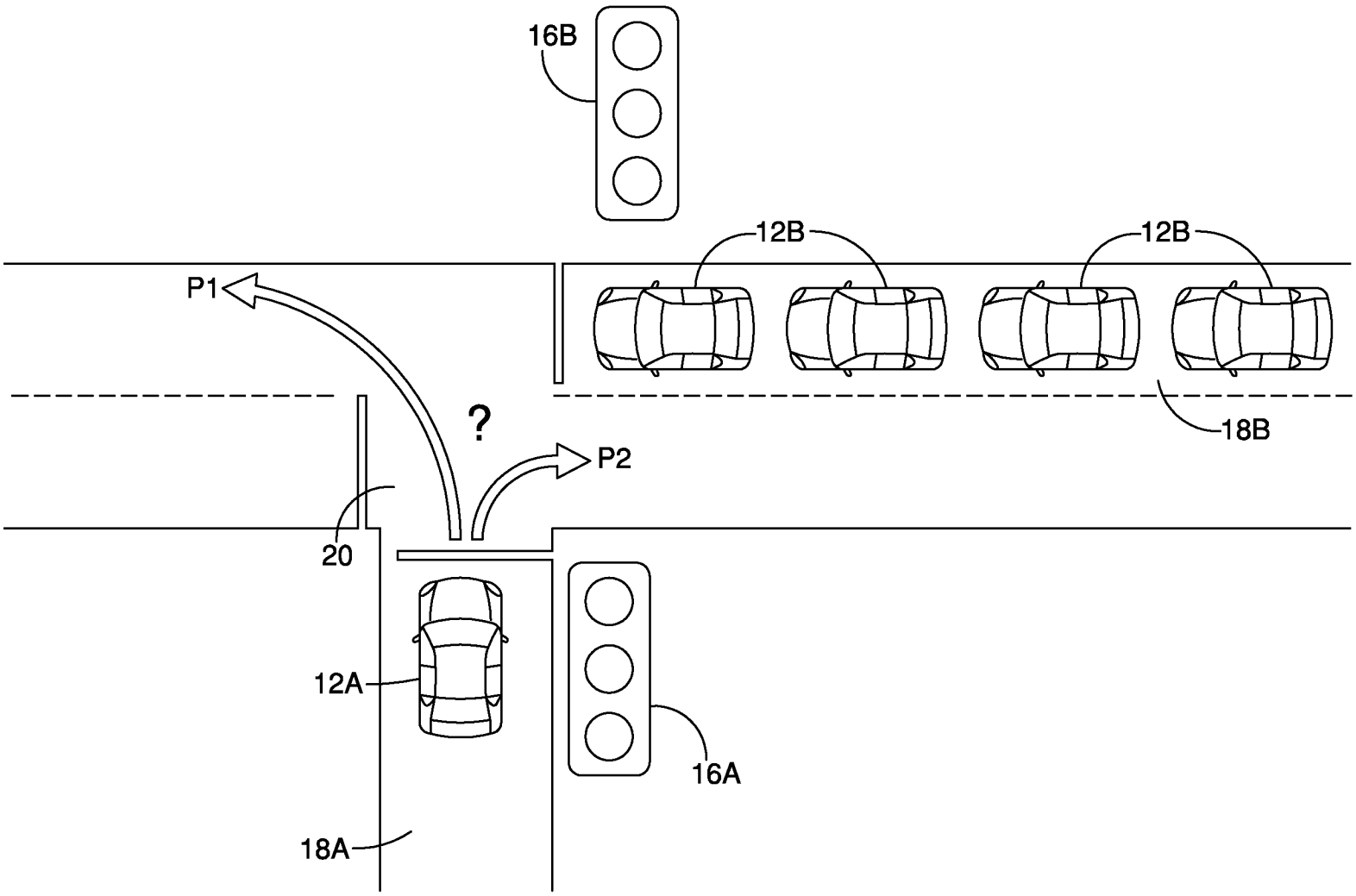
FIGS. 5A to 5E illustrate an example embodiment of an implementation of the system of FIG. 1 and the method of FIG. 3.

FIGS. 5A to 5E illustrate a first example embodiment in which the system 10 and method 100 discussed herein can improve traffic flow. In FIG. 5A, an intersection 20 is shown with a first vehicle 12A stopped in a first lane 18A controlled by a first traffic light 16A, and with a plurality of second vehicles 12B stopped in a second lane 18B controlled by a second traffic light 16B. The first vehicle 12A has the option of turning left along a first available path P1 or right along a second available path P2. Without knowing which direction the first vehicle 12 intends to turn, the second traffic light 16B must remain red when the first traffic light 16A turns green, thus forcing the plurality of second vehicles 12B to wait at the intersection 20 even if the first vehicle 12A turns right along the second available path P2.

Using the system 10 and method 100 discussed herein, however, the central controller 14 can use data 42 from the first vehicle 12A to determine whether the first vehicle 12A intends to proceed along the first available path P1 or the second available path P2. If the first vehicle 12A's directional data 42*b* indicates a left turn, then the central controller 14 can determine that the first available path P1 is the intended path. If the first vehicle 12A's directional data 42*b* indicates a right turn, then the central controller 14 can determine that the second available path P2 is the intended path.

Figure 5B:
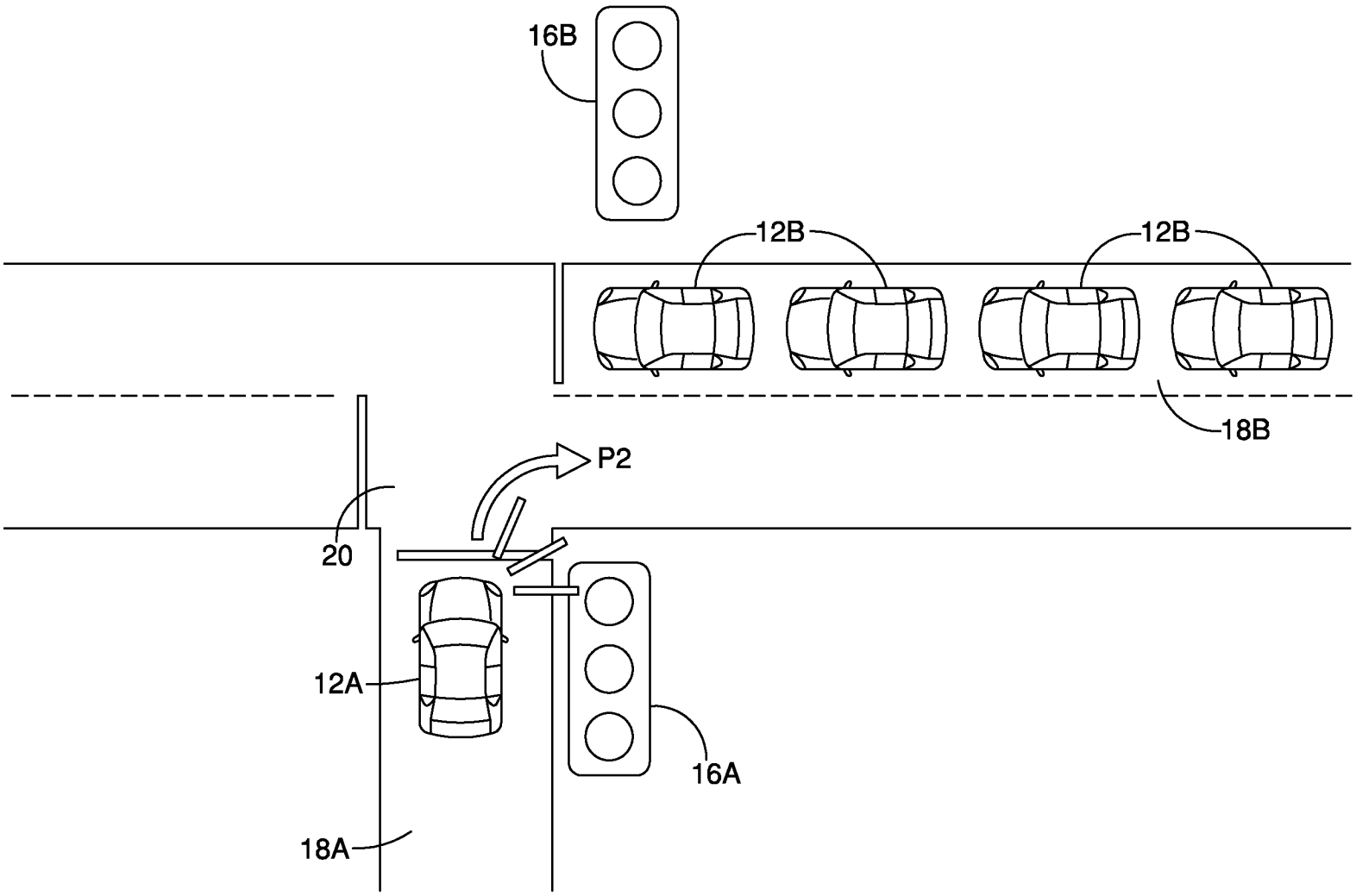
Figure 5C:
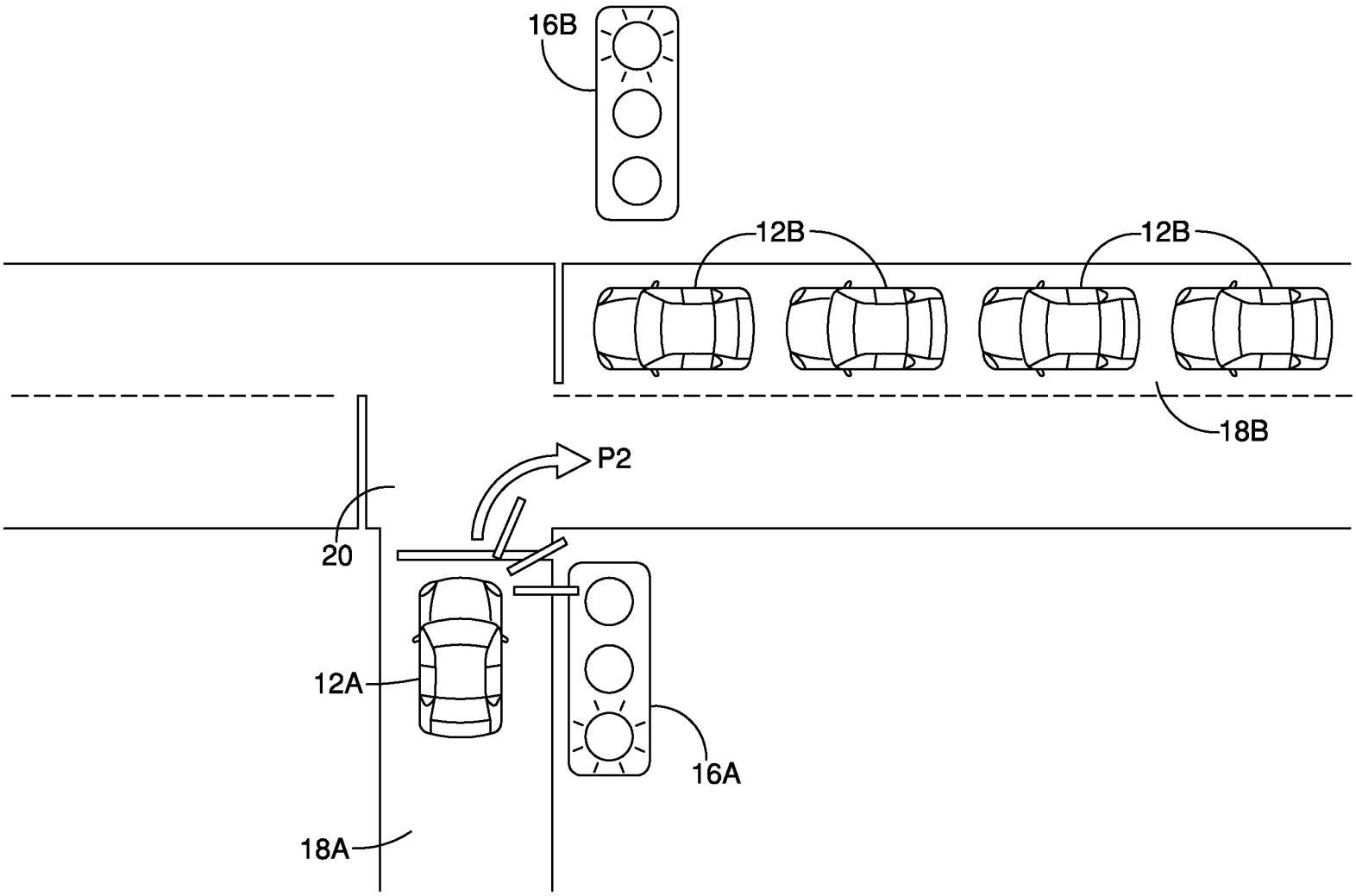

Once the central controller 14 determines the intended path, the central controller 14 can determine whether the existing traffic control logic should be altered. In FIG. 5B, the central controller 14 has determined that the second available path P2 is the intended path of the first vehicle 12A. In this example, the existing traffic control logic is illustrated by FIG. 5C. Thus, by the existing traffic control logic, the first traffic light 16A is green and the second traffic light 16B is red, for example, for a predetermined amount of time until the traffic signals 60 switch. Thus, under the existing traffic control logic, the first vehicle 12A can continue to turn right, but the plurality of second vehicles 12B must wait at a red light until the scheduled change.

Figure 5D:
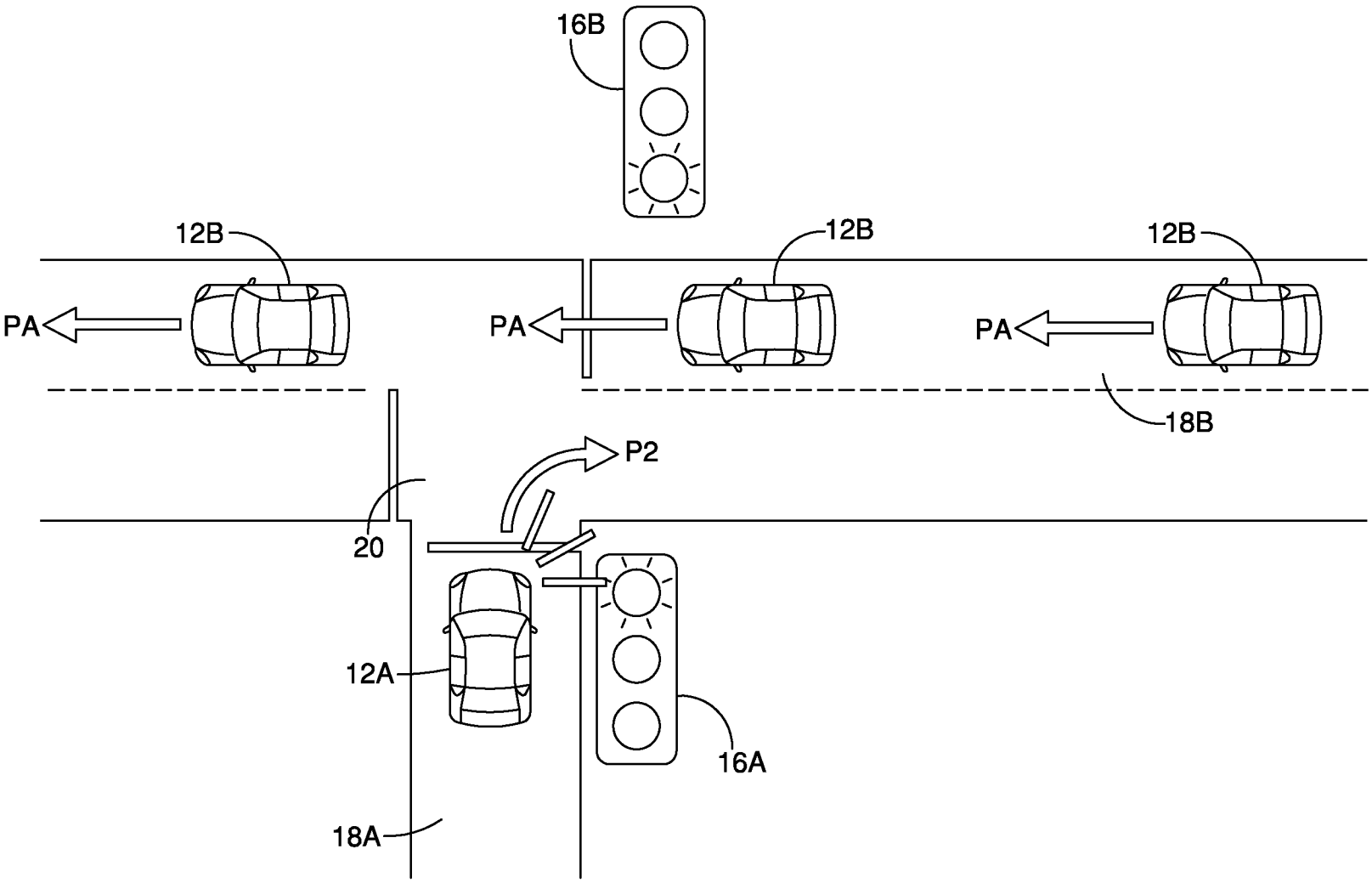

Here, the central controller 14 can determine that the alternative path PA of the second vehicles 12B through the intersection 20 does not interfere with the intended path of the first vehicle 12A (e.g., also using first signals 22 from the second vehicles 12B). The central controller 14 can further determine that the first vehicle 12A can take the intended path P2 during a red light (i.e., turn right on red). Thus, the central controller 14 can determine that an amount of time that the second vehicles 12B are stopped at the intersection 20 can be reduced by using updated traffic control logic which immediately swaps the traffic signals, i.e., immediately changes the first traffic light 16A to red and the second traffic light 16B to green. The central controller 14 can also determine that vehicle load within the second lane 18B and/or overall at the intersection 20 can be reduced immediately by using this updated traffic control logic. As illustrated in FIG. 5D, this configuration from the updated traffic control logic enables the first vehicle 12A to proceed along the intended path (e.g., turn right on red) at the same time that the plurality of second vehicles 12B proceed through the intersection along the alternative path PA. Thus, the central controller 14 sends a second signal 24 with traffic control instructions 70 which cause the traffic lights 16A, 16B to operate according to this updated traffic control logic.

Figure 5E:
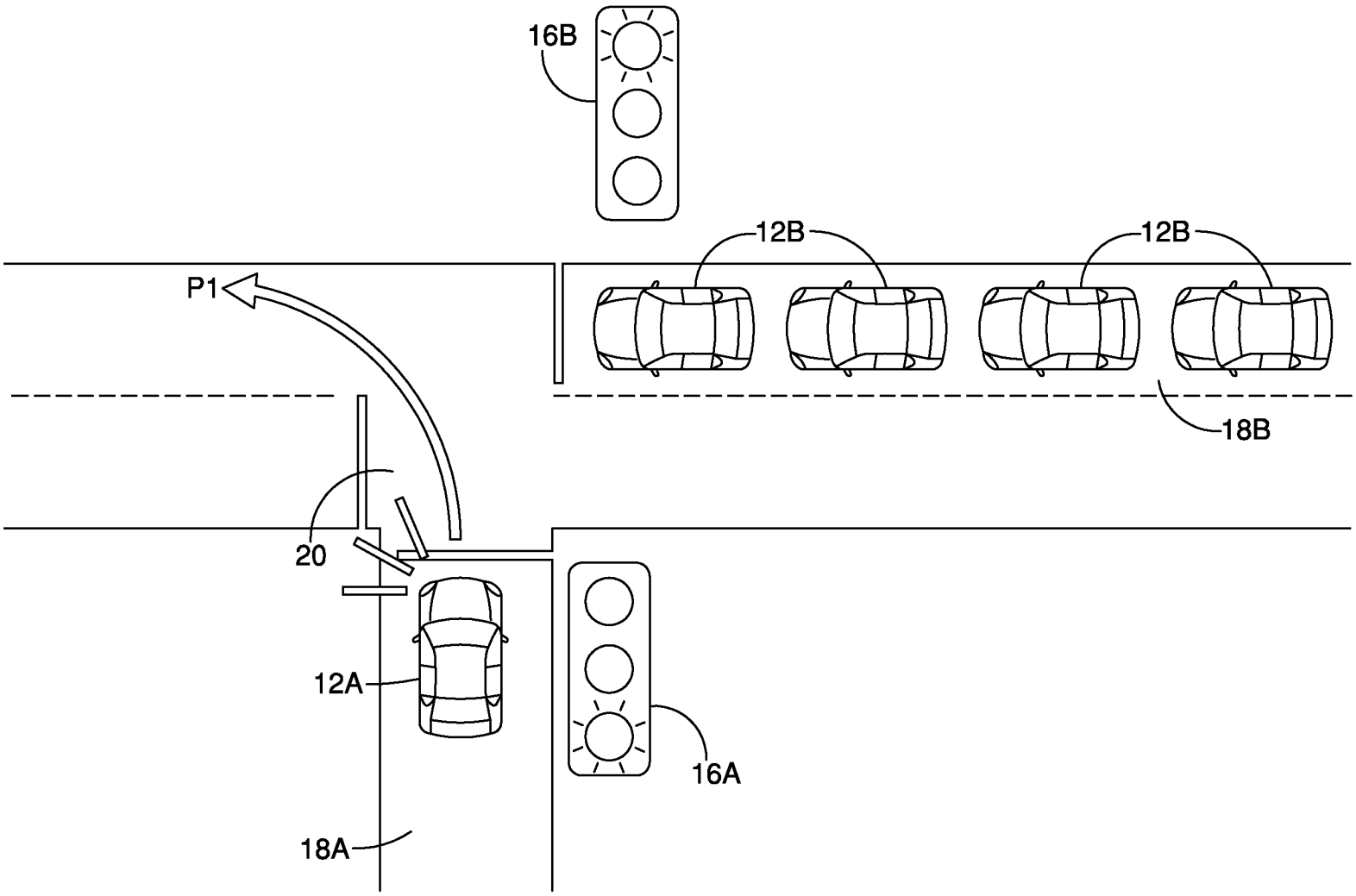

FIG. 5E illustrates the alternative situation in which the central controller has determined that the first available path P1 is the intended path of the first vehicle 12A. As discussed above with reference to FIG. 5C, the existing traffic control logic has the first traffic light 16A as green and the second traffic light 16B as red, for example, for a predetermined amount of time until the traffic signals 60 switch. Thus, in this case, the alternative path PA of the second vehicles 12B through the intersection interferes with the intended path of the first vehicle 12A. The central controller 14 can therefore determine that the traffic should proceed according to the existing traffic control logic so that the first vehicle 12A can turn left, and thus the central controller 14 will not send a second signal 24 causing an adjustment to the traffic signals 60.

In a more detailed embodiment of FIG. 5E, the central controller 14 can generate updated traffic control logic which causes an adjustment in the traffic signals 60 after the first vehicle 12A has passed through the intersection 20. For example, the central controller 14 can determine that there is only one vehicle 12 that intends to take the first available path P1, and can generate updated traffic control logic which alters the timing of the traffic signals 60 so that the second traffic light 16B turns green faster than it otherwise would have under the existing traffic control logic.

Figure 6A:
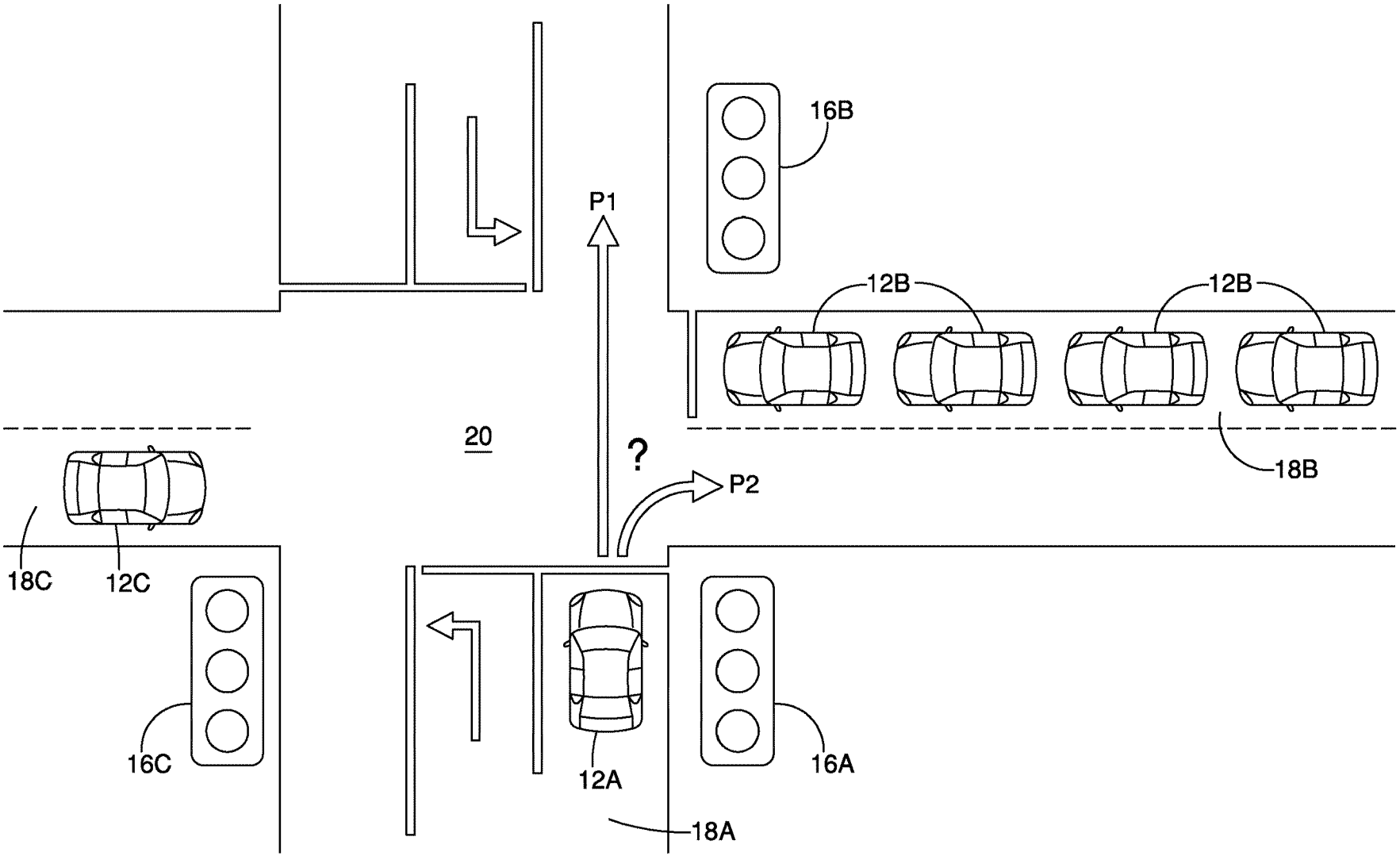
FIGS. 6A to 6F illustrate another example embodiment of an implementation of the system of FIG. 1 and the method of FIG. 3.

FIGS. 6A to 6F illustrate a second example embodiment in which the system 10 and method 100 discussed herein can improve traffic flow. In FIG. 6A, an intersection 20 is shown with a first vehicle 12A stopped in a first lane 18A controlled by a first traffic light 16A, a plurality of second vehicles 12B stopped in a second lane 18B controlled by a second traffic light 16B, and a third vehicle 12C stopped in a third lane 18C controlled by a third traffic light 16C. Based on the current location within lane 18A, the first vehicle 12A has the option of proceeding straight along a first available path P1 or turning right along a second available path P2. Without knowing which direction the first vehicle 12 intends to turn, the second traffic light 16B and the third traffic light 18C must remain red when the first traffic light 16A turns green, thus forcing the plurality of second vehicles 12B and the third vehicle 12C to wait at the intersection 20 even if the first vehicle 12A turns right.

Using the system 10 and method 100 discussed herein, however, the central controller 14 can use the data 42 from the first vehicle 12A to determine whether the first vehicle 12A intends to proceed along the first available path P1 or the second available path P2. If the first vehicle 12A's directional data 42*b* indicates a straight path, then the central controller 14 can determine that the first available path P1 is the intended path. If the first vehicle 12A's directional data 42*b* indicates a right turn, then the central controller 14 can determine that the second available path P2 is the intended path.

Figure 6B:
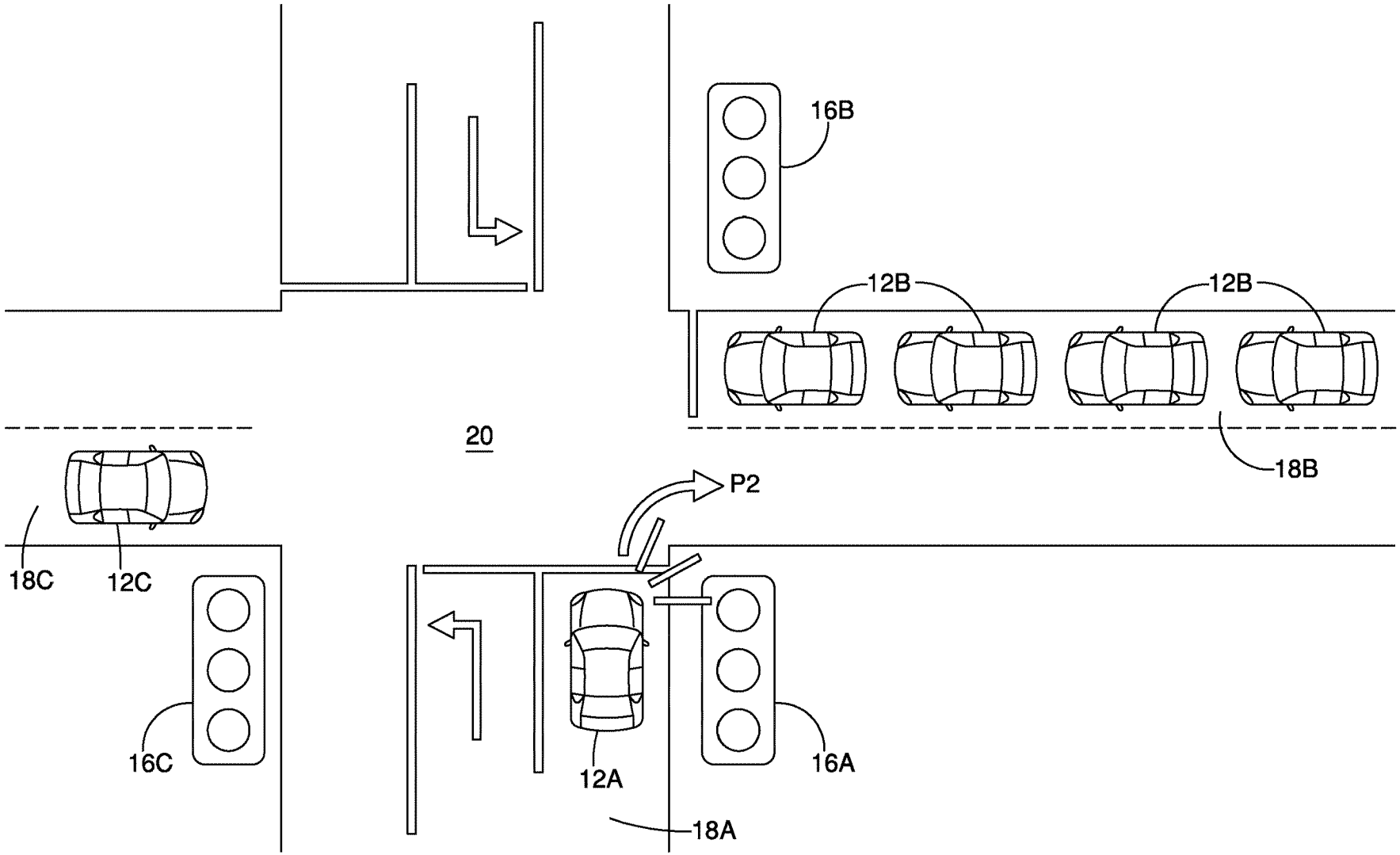
Figure 6C:
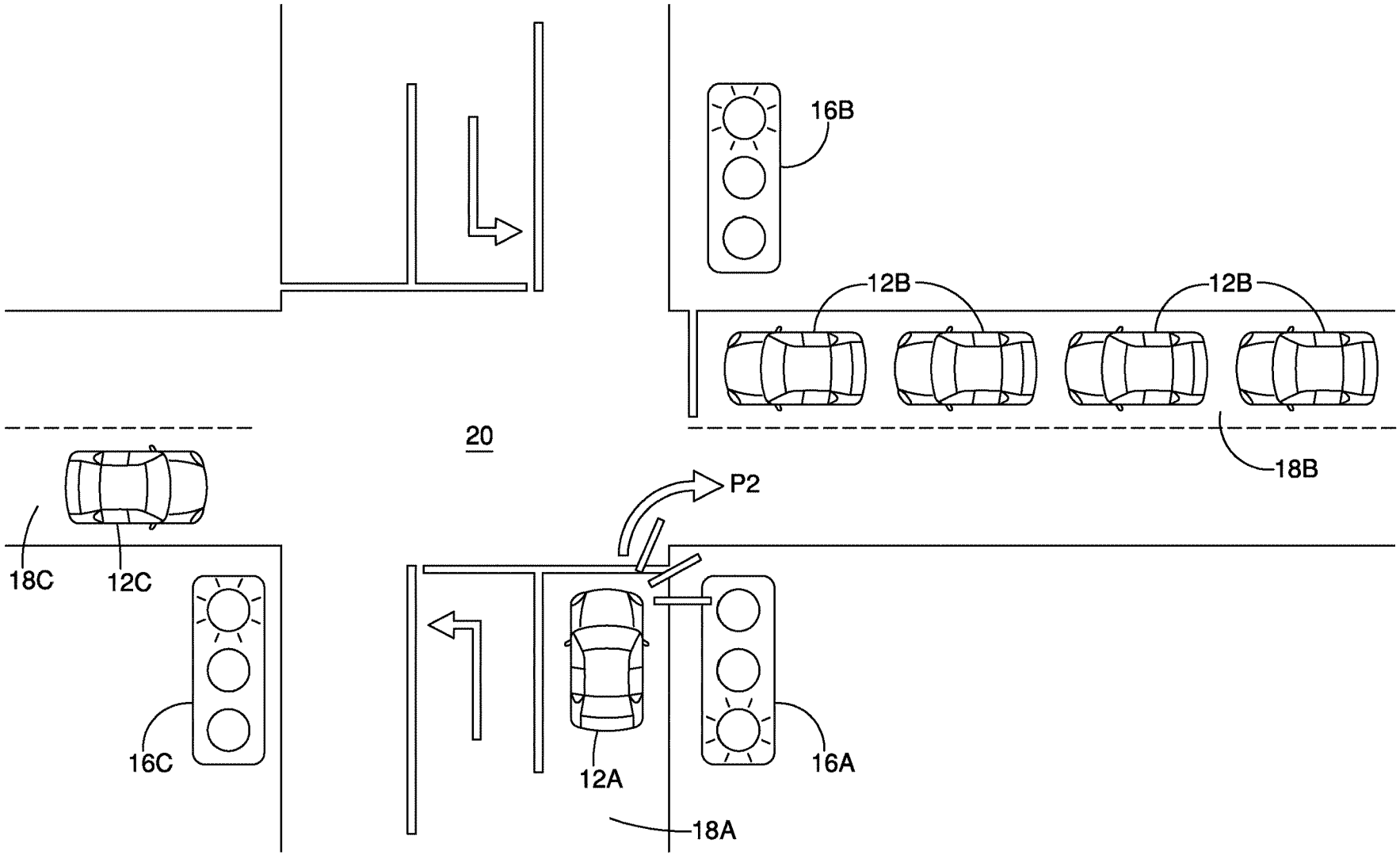

Once the central controller 14 determines the intended path, the central controller 14 can determine whether the existing traffic control logic should be altered. In FIG. 6B, the central controller 14 has determined that the second available path P2 is the intended path of the first vehicle 12A. In this example, the existing traffic control logic is illustrated by FIG. 6C. Thus, by the existing traffic control logic, the first traffic light 16A is green and the second traffic light 16B and the third traffic light 16C are red, for example, for a predetermined amount of time until the traffic signals 60 switch. Thus, under the existing traffic control logic, the first vehicle 12A can continue to turn right, but the plurality of second vehicles 12B and the third vehicle 16C must wait at a red light until the scheduled adjustment.

Figure 6D:
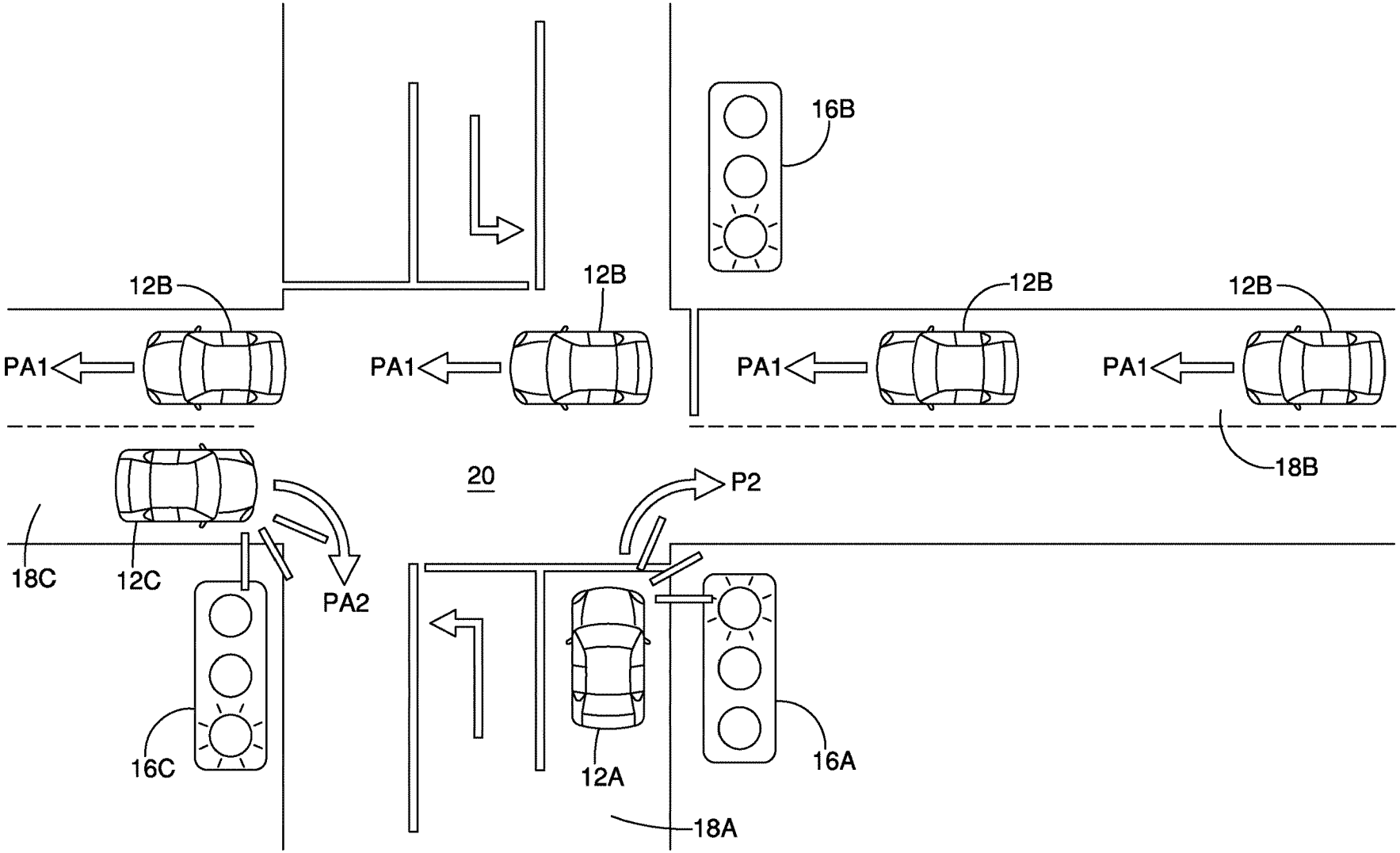

Here, the central controller 14 can determine that the alternative path PA1 of the second vehicles 12B through the intersection 20 does not interfere with the intended path of the first vehicle 12A (e.g., also using first signals 22 from the second vehicles 12B). Thus, the central controller 14 can determine that amount of time for the second vehicles 12B can be reduced by using updated traffic control logic which immediately changes the first traffic light 16A to red and the second traffic light 16B to green. The central controller 14 can also determine that vehicle load within the second lane 18B and/or overall at the intersection 20 can be reduced immediately by using this updated traffic control logic. As illustrated in FIG. 6D, this configuration from the updated traffic control logic enables the first vehicle 12A to proceed along the intended path (e.g., turn right on red) at the same time that the plurality of second vehicles 12B proceed through the intersection along the first alternative path PA1. Thus, the central controller sends a second signal 24 with traffic control instructions 70 which cause the traffic lights 16A, 16B to operate according to this updated traffic control logic.

Additionally, as illustrated in FIG. 6D, if the central controller 14 receives a first signal 22 from the third vehicle 12C, then the central controller 14 can use that additional information in the updated traffic control logic. Here, the central controller 14 has determined that the third vehicle 12C's intended path is a right turn, so the intended alternative path PA2 of the third vehicle 12A also does not interfere with the intended path P2 of the first vehicle 12A or the intended path PA1 of the second vehicles 12B. The central controller 14 can therefore cause the third traffic light 16C to change to green so that all of the first vehicle 12A, the second vehicles 12B, and the third vehicle 12C can proceed through the intersection 20 at the same time, thus reducing the times of the vehicles 12A, 12B, 12C through the intersection 20 and the load in each lane 18A, 18B, 18C and overall at the intersection 20.

Figure 6E:
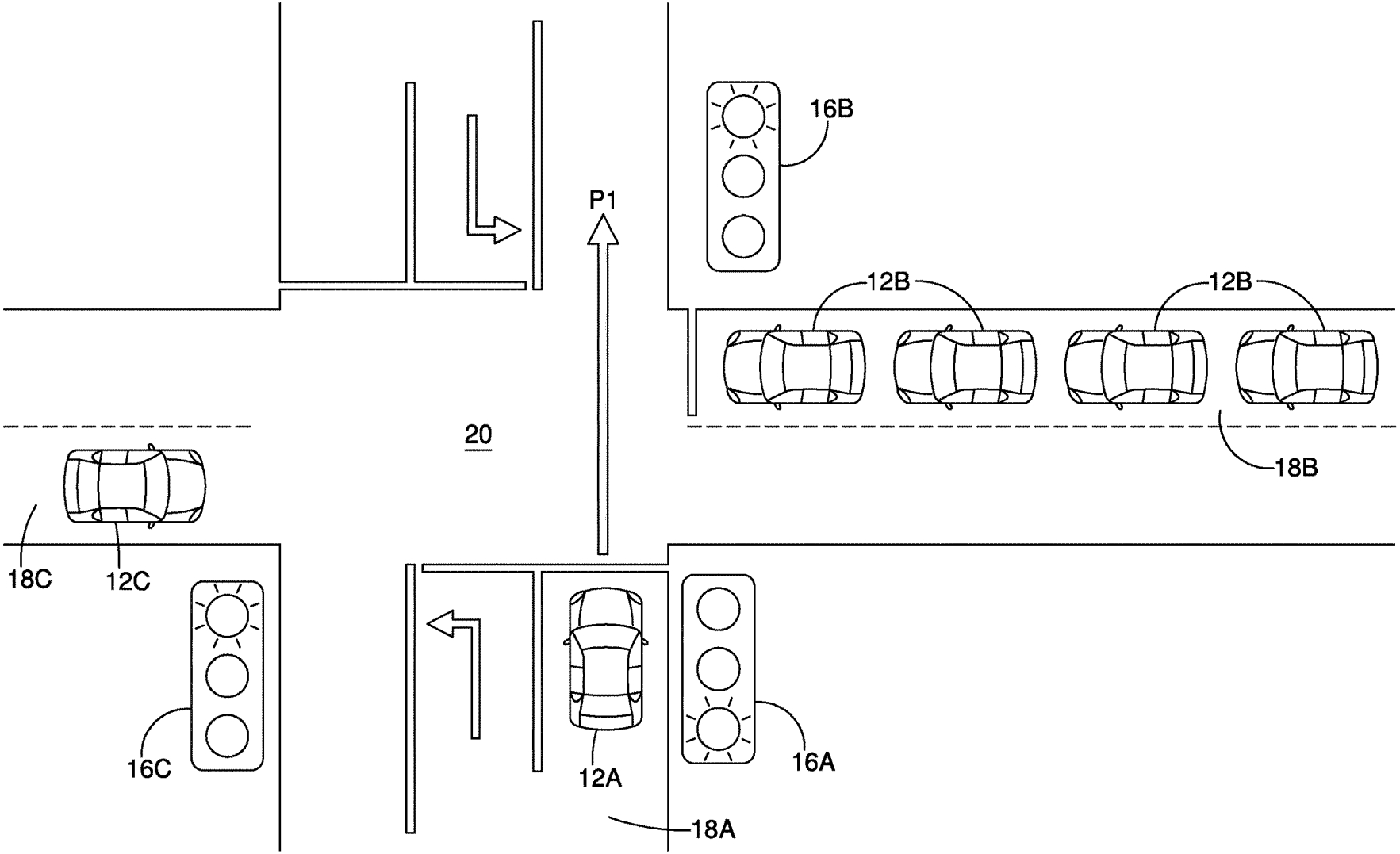

FIG. 6E illustrates the alternative situation in which the central controller 14 has determined that the first available path P1 is the intended path of the first vehicle 12A. As discussed above with reference to FIG. 6C, the existing traffic control logic has the first traffic light 16A as green and the second traffic light 16B as red, for example, for a predetermined amount of time until the traffic signals 60 switch. Thus, in this case, the intended alternative path PA1 of the second vehicles 12B through the intersection interferes with the intended path P1 of the first vehicle 12A. The central controller 14 can therefore determine that the first traffic light 16A and the second traffic light 16B should proceed according to the existing traffic control logic so that the first vehicle 12A can proceed straight, and thus the central controller 14 will not send a second signal 24 causing adjustment to the first traffic light 16A and the second traffic light 16B.

Figure 6F:
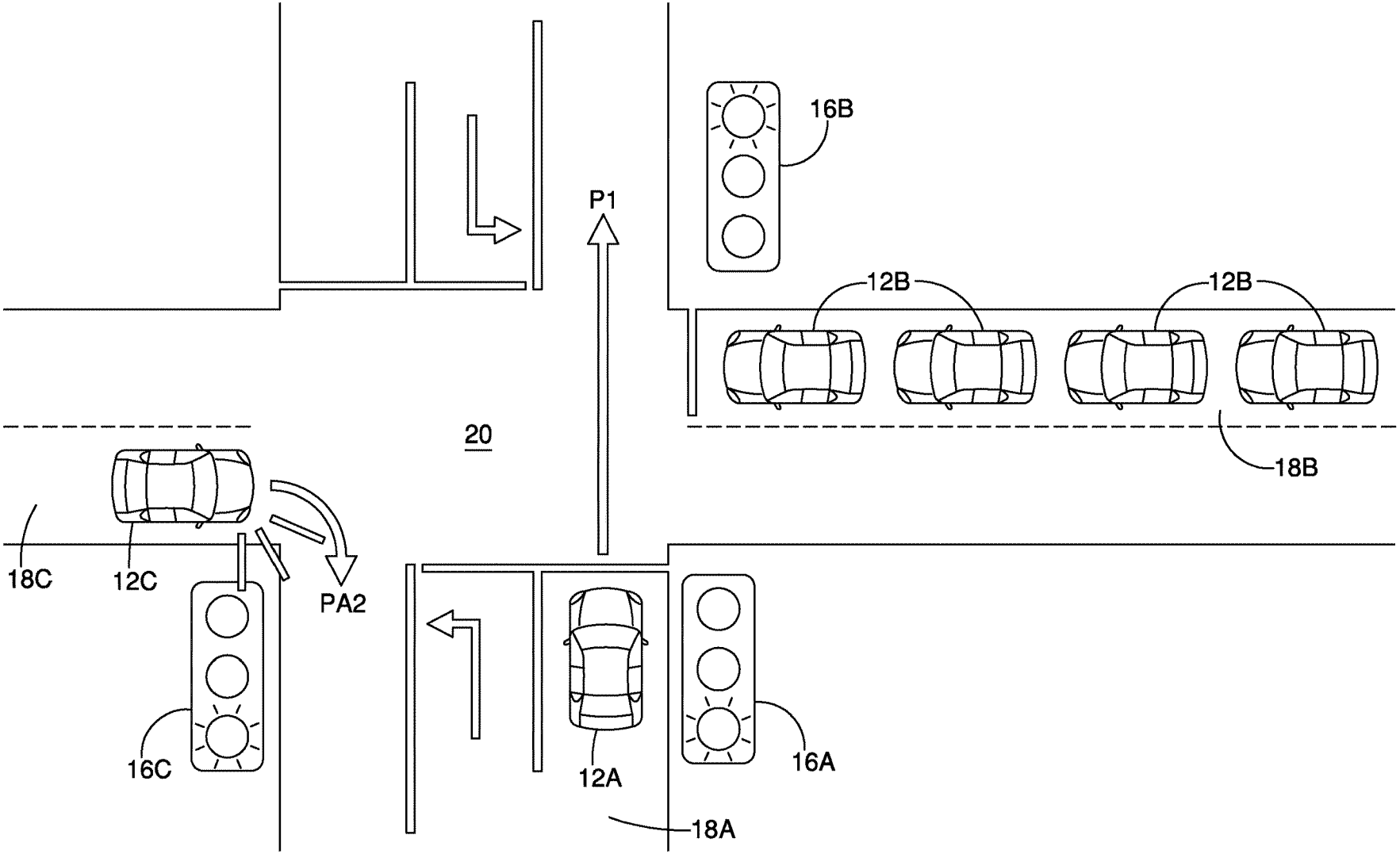

Additionally, as illustrated in FIG. 6F, if the central controller 14 receives a first signal 22 from the third vehicle 12C, then the central controller 14 can still determine that the third traffic light 16C should be adjusted. Here, the central controller 14 has determined that the third vehicle 12C's intended path is a right turn, so the intended alternative path PA2 of the third vehicle 12A does not interfere with the intended path P1 of the first vehicle 12A. The central controller 14 can therefore cause the third traffic light 16C to change to green while keeping the first traffic light 16A and the second traffic light 16B operating according to the existing traffic control logic, thus reducing the time for the third vehicle 12C to pass through the intersection and the load in lane 18C.

In a more detailed embodiment of FIG. 6F, the central controller 14 can generate updated traffic control logic which causes an adjustment to the traffic signals 60 after the first vehicle 12A has passed through the intersection. For example, the central controller 14 can determine that there is only one vehicle 12 that intends to take the first available path P1, and can generate updated traffic control logic which alters the timing of the traffic signals 60 so that the second traffic light 16B and/or the third traffic light 16C turn green faster than they otherwise would have under the existing traffic control logic, which allows the second vehicles 12B and the third vehicle 12C to proceed through the intersection 20 in a lesser amount of time than otherwise under the original traffic control logic.

Figure 7A:
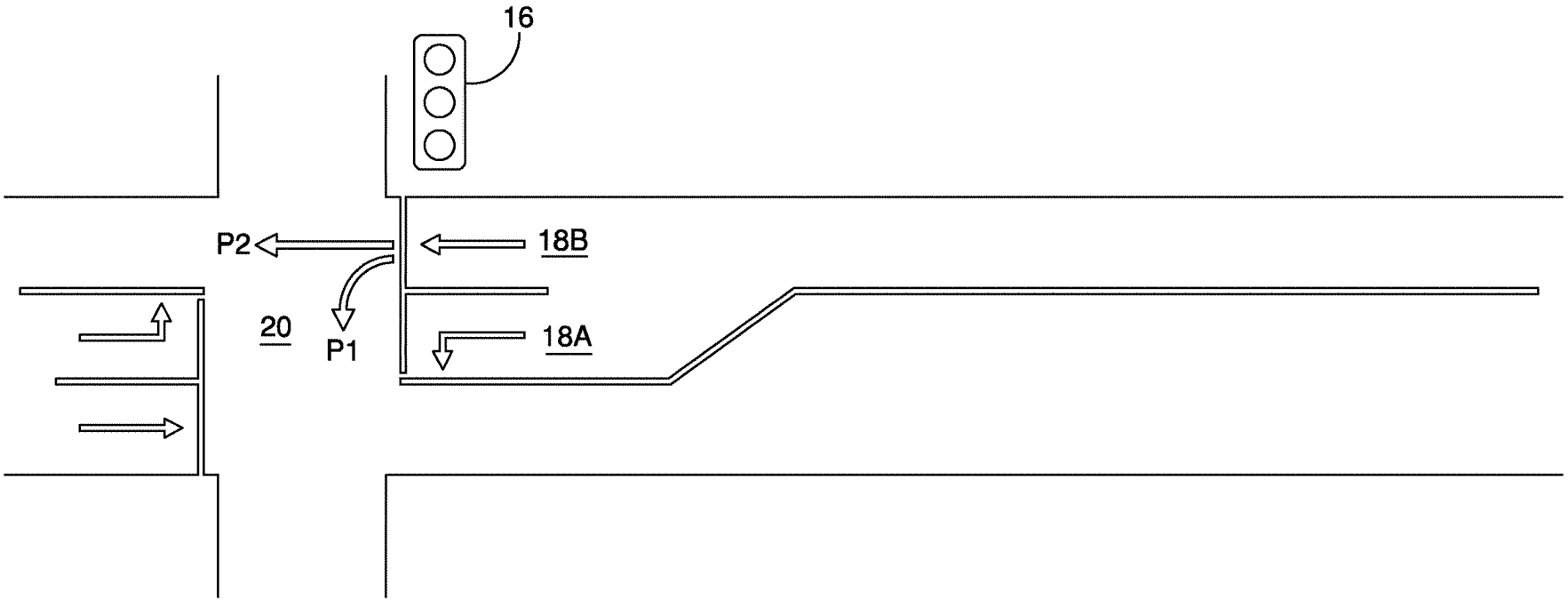
FIGS. 7A to 7C illustrate another example embodiment of an implementation of the system of FIG. 1 and the method of FIG. 3.
Figure 7B:
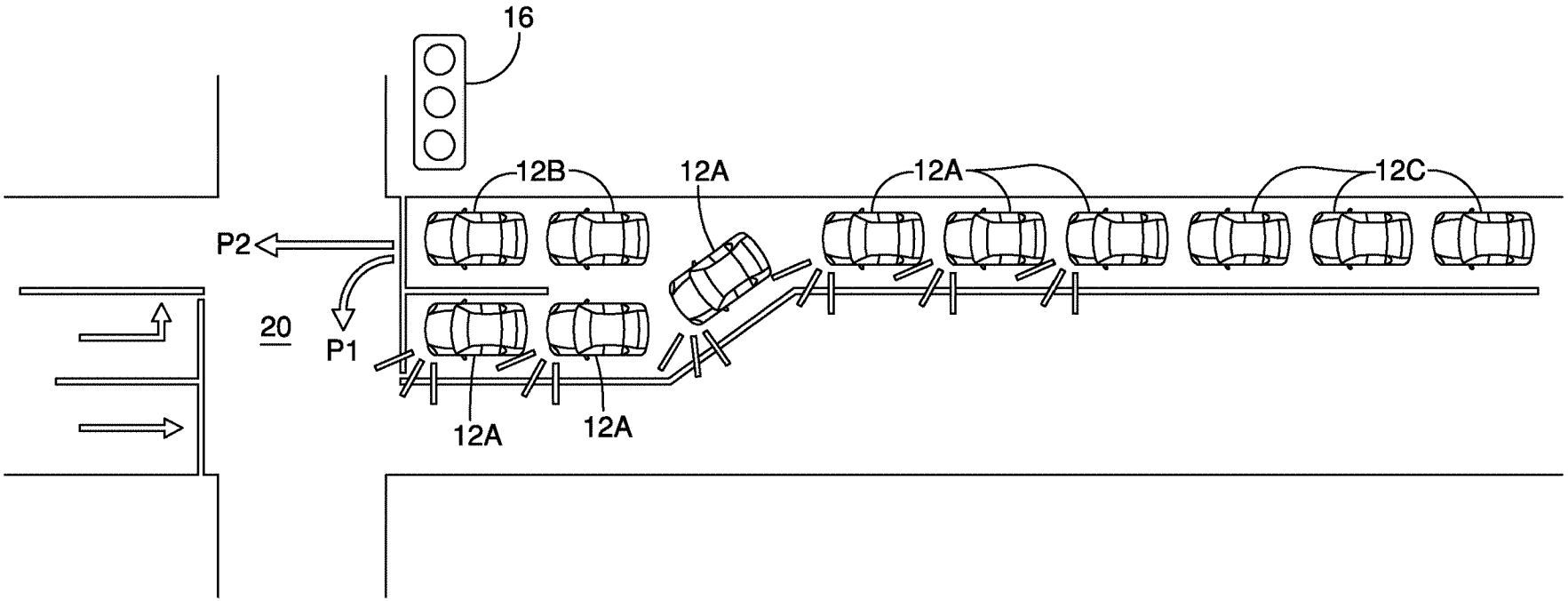
Figure 7C:
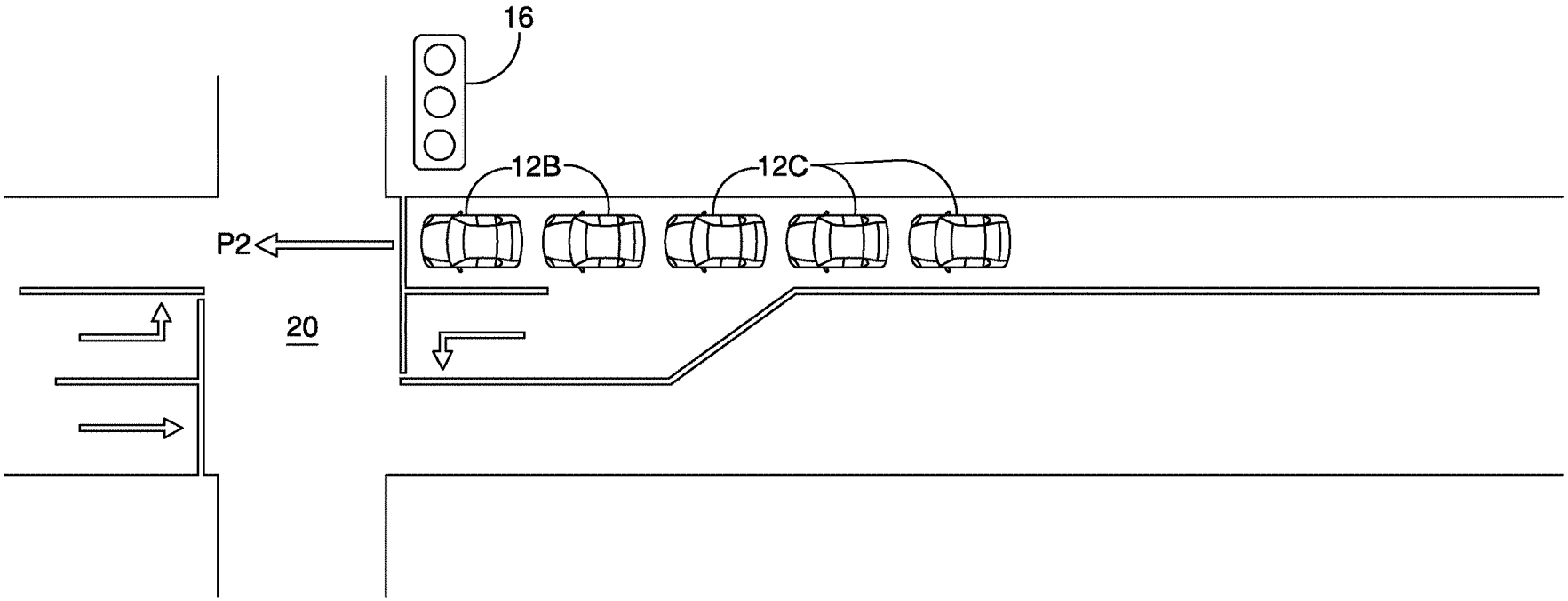

FIGS. 7A to 7C illustrate a third example embodiment of an intersection 20 which can benefit from the system 10 and method 100 discussed herein. As illustrated in FIG. 7A, a lane 18 of the intersection 20 includes a left turn lane 18A and a straight lane 18B controlled by at least one traffic light 16. A vehicle 12 turning left through the intersection 20 has a first intended path P1, and a vehicle 12 proceeding straight through the intersection 20 has a second intended path P2.

As shown in FIG. 7B, the configuration of the lane 18 can cause a backup, for example, if multiple vehicles 12 intend to turn left. Here, six first vehicles 12A intend to turn left with an intended path P1, two second vehicles 12B intend to proceed straight with an intended path P2 and have a clear path, and three third vehicles 12C intend to proceed straight with an intended path P2 but cannot move until several of the first vehicles 12A move out of the way. The central controller 14 can determine the intended paths of each of the vehicles 12A, 12B, 12C, for example, by receiving respective first signals 22 including positional data 42*a* and/or directional data 42*b* from each of the vehicles 12A, 12B, 12C.

Here, using positional data from the vehicles 12A, 12B, 12C, the central controller 14 can also determine that several of the first vehicles 12A are stopped in the same lane as the third vehicles 12C. Thus, although the two second vehicles 12B can proceed straight in this configuration, the current position of the first vehicles 12A prevents the third vehicles 12C from proceeding through the intersection 20 along the intended path P2. It would therefore be beneficial to reduce the traffic load by allowing the six first vehicles 12A to turn left along the first intended path P1 so as not to interfere with the second intended path P2 of the third vehicles 12C. In FIG. 7B, the first intended path P1 of several of the first vehicles 12A interferes with the second intended path P2 of the third vehicles 12C due to the current location of the first vehicles 12A.

Using the system 10 and method 100 discussed herein, the central controller 14 can use the data 42 from the first vehicles 12A to determine that there is a backlog of first vehicles 12A intending to turn left. Thus, once the central controller 14 determines that the six first vehicles 12A have an intended path P1 that is a left turn from the left turn lane 18A, the central controller 14 can determine whether the existing traffic control logic should be adjusted. For example, the central controller 14 can adjust the length of a traffic signal 60 to allow all six first vehicles 12A to pass through the intersection 20 at once (e.g., by calculating a time to allow six vehicles through the intersection 20 as shown by FIG. 4). As seen in FIG. 7C, this updated traffic control logic allows the third vehicles 12C to then proceed through the intersection 20 along their respective intended path P2 at the same time as the second vehicles 12B, thus decreasing the time for the majority of the vehicles 12 through the intersection 20 and likewise decreasing the traffic load at the intersection 20. Thus, in an embodiment, the traffic load can be reduced more quickly using two traffic signal cycles (e.g., first for the first vehicles 12A turning left, then for the second and third vehicles 12B, 12C proceeding straight) where three cycles would have been used under the original traffic control logic (first for the second vehicles 12B proceeding straight, then for the first vehicles 12A turning left, then for the third vehicles 12C proceeding straight).

In an embodiment, the central controller 14 can determine a number of vehicles 12 to allow through the intersection at one time. The number can be based on a distance from the intersection 20, for example, as determined by locational data 42*a*. The number can also be based on the number of vehicles 12 backed up into another lane, for example, as determined by locational data 42*a*. The number can also be based on the number of vehicles 12 with interfering intended paths.

In another embodiment, for example if the second vehicles 12B are allowed to proceed through the intersection 20 before the first vehicles 12A, the central controller 14 can then determine that the third vehicles 12C cannot move until the first vehicles 12A move. Thus, upon determining that the total number of vehicles 12 stopped at the intersection 20 cannot be reduced until the first vehicles 12A move, the central controller 14 can cause an adjustment of the traffic signal 60 to allow the first vehicles 12A to immediately proceed through the intersection 20 along the intended path P1.

It should be understood from this disclosure that the above examples are simplified examples of the disclosed method 100 and are not intended to be limiting. Those of ordinary skill in the art should be able to apply the present disclosure to all types of intersections 20 to reduce time and/or a traffic load. Further, the above example embodiments are described with respect to vehicles 12 and traffic lights 16, but it should also be understood from this disclosure that signals for pedestrian walkways can be altered in the same way. That is, the second signal 24 from the central controller 14 can update the traffic lights 16 for the vehicles 12 and/or signals for pedestrian walkways. In this way, the time for pedestrians to walk through the intersection 20 can be improved in addition to or instead of the vehicle traffic.

Figure 8:
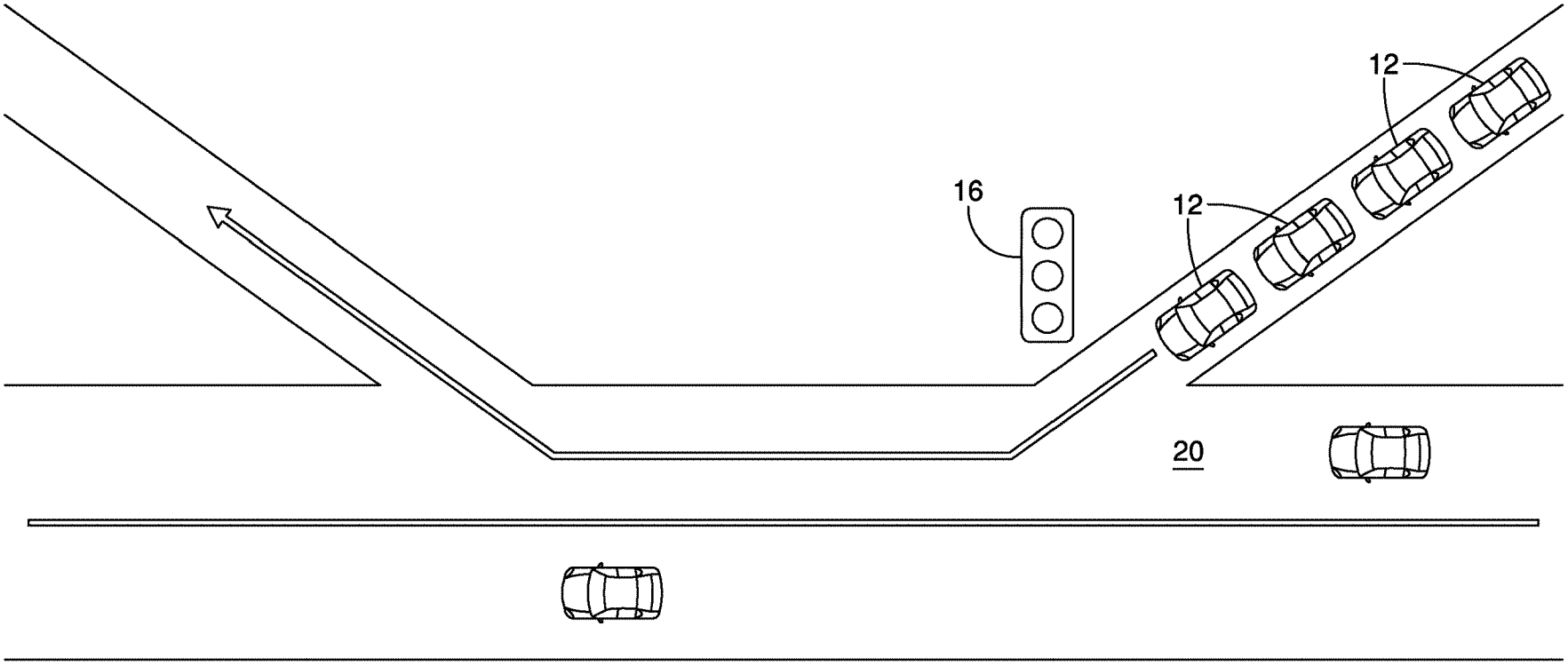
FIG. 8 illustrates another example embodiment of an implementation of the system of FIG. 1 and the method of FIG. 3.

As discussed above, the system 10 and method 100 discussed herein can also utilize data 42 from a vehicle navigation system 38 instead of or in addition to data from a turn signal input device 34. The data from a vehicle navigation system 38 can include, for example, the entire route intended by a vehicle 12, including all intended turns along that route. FIG. 8 illustrates one such example embodiment when use of the vehicle navigation system 38 can be beneficial in improving traffic flow. Here, a plurality of vehicles 12 are stopped at a traffic light 16 at an intersection 20 of a highway onramp. In this situation, the traffic light 16 typically causes each vehicle to wait for a predetermined time for the purpose of controlling traffic on the highway.

In an embodiment, the central controller 14 can use the vehicle navigation system data 38 of each vehicle 12 to alter the timing of the traffic light 16. For example, in FIG. 8, the first vehicle 12 does not intend to remain on the highway for longer than a predetermined distance. Rather, the first vehicle 12 intends to take the next offramp. Thus, the central controller 14 can alter the traffic light 16 to allow the first vehicle 12 onto the highway without stopping, knowing that the first vehicle 12 will soon exit the highway and will not add to the overall traffic load on the highway. By doing so, the central controller 14 can reduce the traffic load on the onramp and prevent a further backup.

Those of ordinary skill in the art will recognize other ways that route information from the vehicle navigation system 38 can be used to improve traffic flow. Using the route information, the vehicle navigation system 38 knows the intended directions that the vehicle intends to turn through a plurality of intersections, and the vehicle controller 30 can send that information to a central controller 14 long before the vehicle 12 approaches the intersection 20, allowing the central controller 14 to optimize traffic flow in advance and minimize the amount of time that vehicles 12 are forced to stop at the intersection 20.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "configured" as used herein to describe a component, section or part of a device includes hardware and/or software that is constructed and/or programmed to carry out the desired function.

The term "processor" as used herein can refer to one or more processors, such as one or more special purpose processors, one or more digital signal processors, one or more microprocessors, and/or one or more other processors as known in the art.

The term "memory" as used herein can refer to any computer useable or computer readable medium or device that can contain, store, communicate, or transport any signal or information that can be used with any processor. For example, a memory can include one or more read only memory (ROM), random access memory (RAM), one or more other memory, and/or combinations thereof.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A method for optimizing traffic flow through an intersection, the method comprising:

receiving positional data indicating a current location of a first vehicle intending to pass through the intersection;

receiving directional data indicating an intended direction of the first vehicle through the intersection from the current location;

determining, based on the positional data and the directional data, whether an intended path of the first vehicle through the intersection interferes with an alternative path of a second vehicle through the intersection; and adjusting a traffic signal at the intersection to decrease an amount of time for the second vehicle to pass through the intersection via the alternative path.

2. The method of claim 1, wherein at least one of: (i) the positional data includes global positioning system data from the first vehicle; and (ii) the directional data includes turn signal data from the first vehicle.

3. The method of claim 1, further comprising receiving orientation data indicating a directional orientation of the first vehicle, and using the orientation data with the positional data and the directional data to determine whether the intended path of the first vehicle interferes with the alternative path through the intersection.

4. The method of claim 1, wherein the second vehicle is facing a different direction than the first vehicle at the intersection.

5. The method of claim 1, wherein the second vehicle is facing a same direction as the first vehicle at the intersection.

6. The method of claim 1, further comprising determining whether the intended path of the first vehicle through the intersection interferes with an alternative path for a pedestrian passing through the intersection along a walkway.

7. The method of claim 1, wherein adjusting the traffic signal includes increasing or decreasing a duration of the traffic signal for at least one direction through the intersection.

8. The method of claim 1, wherein adjusting the traffic signal includes altering an order of traffic signals for alternative lanes through the intersection.

9. A method for optimizing traffic flow through an intersection, the method comprising:

receiving positional data indicating a current location of a first vehicle intending to pass through the intersection;

receiving directional data indicating an intended direction of the first vehicle through the intersection from the current location;

determining, based on the positional data and the directional data, an intended path of the first vehicle through the intersection;

determining that a plurality of second vehicles are stopped at the intersection;

determining whether a total number of the plurality of second vehicles stopped at the intersection can be reduced without interfering with the intended path; and adjusting a traffic signal at the intersection to decrease an amount of time needed to reduce the total number of the plurality of second vehicles stopped at the intersection.

10. The method of claim 9, wherein at least one of: (i) the positional data includes global positioning system data from the first vehicle; and (ii) the directional data includes turn signal data from the first vehicle.

11. The method of claim 9, further comprising receiving the positional data and the directional data, respectively, from one or more of the plurality of second vehicles stopped at the intersection, calculating a time needed to allow several of the plurality of second vehicles to pass through the intersection, and adjusting the traffic signal based on the calculated time.

12. The method of claim 9, wherein upon determining that the total number of the plurality of second vehicles stopped at the intersection can be reduced without interfering with the intended path, adjusting the traffic signal to allow at least one of the plurality of second vehicles to immediately proceed through the intersection.

13. The method of claim 9, wherein upon determining that the total number of the plurality of second vehicles stopped at the intersection cannot be reduced without interfering with the intended path, adjusting the traffic signal to allow the first vehicle to immediately proceed through the intersection.

14. The method of claim 9, wherein adjusting the traffic signal includes increasing or decreasing a duration of the traffic signal.

15. The method of claim 9, wherein adjusting the traffic signal includes altering an order of traffic signals for alternative lanes through the intersection.

16. A method for optimizing traffic flow through an intersection, the method comprising:

receiving, from a first vehicle stopped at the intersection, first positional data indicating a first current location and first directional data indicating a first intended direction through the intersection;

receiving, from a second vehicle stopped at the intersection, second positional data indicating a second current location and second directional data indicating a second intended direction through the intersection;

determining, based on the first positional data and the first directional data, a first intended path of the first vehicle through the intersection;

determining, based on the second positional data and the second directional data, a second intended path of the second vehicle through the intersection;

determining whether the first current position of the first vehicle prevents the second vehicle from proceeding through the intersection along the second intended path; and adjusting a traffic signal at the intersection to allow the first vehicle to pass through the intersection along the first intended path.

17. The method of claim 16, wherein determining whether the first current position of the first vehicle prevents the second vehicle from proceeding through the intersection along the second intended path includes determining the first vehicle and the second vehicle to be stopped within a same lane.

18. The method of claim 16, further comprising calculating a time needed to allow the first vehicle to pass through the intersection along the first intended path, and adjusting the traffic signal based on the calculated time.

19. The method of claim 16, further comprising determining that a plurality of vehicles stopped at the intersection intend to proceed through the intersection along the first intended path, calculating a time needed to allow the plurality of vehicles to proceed through the intersection along the first intended path, and adjusting the traffic signal based on the calculated time.

20. The method of claim 16, further comprising determining that a plurality of vehicles stopped at the intersection intend to proceed through the intersection along the first intended path, determining a number of the plurality of vehicles to allow to proceed through the intersection along the first intended path based on a distance from the intersection; and adjusting the traffic signal to allow the number of the plurality of vehicles to proceed through the intersection along the first intended path.

* * * * *